US011470422B2

(12) United States Patent
Fujii et al.

(10) Patent No.: US 11,470,422 B2
(45) Date of Patent: Oct. 11, 2022

(54) OUT-OF-HEAD LOCALIZATION FILTER DETERMINATION SYSTEM, OUT-OF-HEAD LOCALIZATION FILTER DETERMINATION METHOD, AND COMPUTER READABLE MEDIUM

(71) Applicant: JVCKENWOOD Corporation, Yokohama (JP)

(72) Inventors: Yumi Fujii, Yokohama (JP); Hisako Murata, Yokohama (JP); Kuniaki Takachi, Yokohama (JP); Takahiro Gejo, Yokohama (JP); Mayo Iiyama, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 17/372,365

(22) Filed: Jul. 9, 2021

(65) Prior Publication Data

US 2022/0021976 A1 Jan. 20, 2022

(30) Foreign Application Priority Data

Jul. 20, 2020 (JP) ..... JP2020-123654

(51) Int. Cl.
*H04R 5/033* (2006.01)
*H04R 5/027* (2006.01)
(Continued)

(52) U.S. Cl.
CPC ..... *H04R 5/033* (2013.01); *H04R 5/027* (2013.01); *H04R 5/04* (2013.01); *H04S 7/307* (2013.01); *H04S 2420/01* (2013.01)

(58) Field of Classification Search
None
See application file for complete search history.

(56) References Cited

U.S. PATENT DOCUMENTS

2018/0343535 A1* 11/2018 Murata ..... H04S 3/004
2019/0007784 A1* 1/2019 Murata ..... H04S 7/302
(Continued)

FOREIGN PATENT DOCUMENTS

JP 2018-133708 A 8/2018
JP 2018-191208 A 11/2018
WO WO-2018155164 A1 * 8/2018 ..... H04R 29/004

*Primary Examiner* — Qin Zhu
(74) *Attorney, Agent, or Firm* — Procopio, Cory, Hargreaves & Savitch LLP

(57) ABSTRACT

An out-of-head localization filter determination system according to this embodiment includes a microphone unit that is worn on a user's ear and picks up sounds output from an output unit, a measurement unit that measures a sound pickup signal output from the microphone unit, a data storage unit that stores first preset data related to spatial acoustic transfer characteristics and second preset data related to ear canal transfer characteristics in association with each other, a frequency characteristics acquisition unit that converts the sound pickup signal into a frequency domain and acquires frequency characteristics, an extreme value extraction unit that extracts a local maximum value and a local minimum value of the frequency characteristics, and an envelope calculation unit that calculates first envelope data and second envelope data by interpolating each of the local maximum value and the local minimum value.

6 Claims, 14 Drawing Sheets

(51) Int. Cl.
*H04R 5/04* (2006.01)
*H04S 7/00* (2006.01)

(56) References Cited

U.S. PATENT DOCUMENTS

| | | | | |
|---|---|---|---|---|
| 2019/0373385 | A1 | 12/2019 | Uchida et al. | |
| 2020/0068337 | A1 | 2/2020 | Murata et al. | |
| 2020/0213802 | A1* | 7/2020 | Takachi ..... | G10K 15/00 |

* cited by examiner

| ID OF PERSON BEING MEASURED | LEFT/ RIGHT | SECOND PRESET DATA | | | FIRST PRESET DATA | |
|---|---|---|---|---|---|---|
| | | FIRST ENVELOPE DATA | SECOND ENVELOPE DATA | EAR CANAL TRANSFER CHARACTERISTICS | SPATIAL ACOUSTIC TRANSFER CHARACTERISTICS 1 | SPATIAL ACOUSTIC TRANSFER CHARACTERISTICS 2 |
| ID_A | L | AL_bim_max | AL_bim_min | ECTFL_A | Hls_A | Hro_A |
| ID_A | R | AR_bim_max | AR_bim_min | ECTFR_A | Hrs_A | Hlo_A |
| ID_B | L | BL_bim_max | BL_bim_min | ECTFL_B | Hls_B | Hro_B |
| ID_B | R | BR_bim_max | BR_bim_min | ECTFR_B | Hrs_B | Hlo_B |
| ⋮ | ⋮ | ⋮ | ⋮ | ⋮ | ⋮ | ⋮ |

Fig. 9

| CLUSTER | FIRST REPRESENTATIVE FEATURE QUANTITY | SECOND REPRESENTATIVE FEATURE QUANTITY | ID OF PERSON BEING MEASURED | LEFT/ RIGHT |
|---|---|---|---|---|
| 1 | 1_bim_max | 1_bim_min | ID_A | L |
| | | | ID_A | R |
| | | | ID_B | L |
| | | | ⋮ | ⋮ |
| 2 | 2_bim_max | 2_bim_min | ID_C | L |
| | | | ID_D | L |
| | | | ⋮ | ⋮ |
| ⋮ | ⋮ | ⋮ | ⋮ | ⋮ |
| k | k_bim_max | k_bim_min | ID_Z | L |
| | | | ID_Z | R |
| | | | ⋮ | ⋮ |

Fig. 10

| CLUSTER | FIRST REPRESENTATIVE FEATURE QUANTITY | ID OF PERSON BEING MEASURED | LEFT/ RIGHT |
|---|---|---|---|
| 1 | 1_bim_max | ID_A | L |
| | | ID_A | R |
| | | ID_B | L |
| | | ⋮ | ⋮ |
| 2 | 2_bim_max | ID_C | L |
| | | ID_D | L |
| | | ⋮ | ⋮ |
| ⋮ | ⋮ | ⋮ | ⋮ |
| q | q_bim_max | ID_Z | L |
| | | ID_Z | R |
| | | ⋮ | ⋮ |

Fig. 11

| CLUSTER | SECOND REPRESENTATIVE FEATURE QUANTITY | ID OF PERSON BEING MEASURED | LEFT/ RIGHT |
|---|---|---|---|
| 1 | 1_bim_min | ID_E | L |
| | | ID_E | R |
| | | ID_F | L |
| | | ⋮ | ⋮ |
| 2 | 2_bim_min | ID_G | L |
| | | ID_H | L |
| | | ⋮ | ⋮ |
| ⋮ | ⋮ | ⋮ | ⋮ |
| r | r_bim_min | ID_Y | L |
| | | ID_Y | R |
| | | ⋮ | ⋮ |

Fig. 12

OUT-OF-HEAD LOCALIZATION FILTER DETERMINATION SYSTEM, OUT-OF-HEAD LOCALIZATION FILTER DETERMINATION METHOD, AND COMPUTER READABLE MEDIUM

CROSS REFERENCE TO RELATED APPLICATION

This application is based upon and claims the benefit of priority from Japanese patent application No. 2020-123654, filed on Jul. 20, 2020, the disclosure of which is incorporated herein in its entirety by reference.

BACKGROUND

The present disclosure relates to an out-of-head localization filter determination system, an out-of-head localization filter determination method, and a program.

Sound localization techniques include an out-of-head localization technique, which localizes sound images outside the head of a listener by using headphones. The out-of-head localization technique localizes sound images outside the head by canceling characteristics from the headphones to the ears and giving four characteristics from stereo speakers to the ears.

In out-of-head localization reproduction, measurement signals (impulse sounds etc.) that are output from 2-channel (which is referred to hereinafter as "ch") speakers are recorded by microphones placed on the listener (user)'s ears. Then, a processor generates a filter based on a sound pickup signal obtained by impulse response. Accordingly, a filter in accordance with spatial acoustic transfer characteristics from the speakers to the ear canal where the microphones are placed is generated. The generated filter is convolved to 2-ch audio signals, thereby implementing out-of-head localization reproduction.

Further, in order to generate a filter for canceling out characteristics from headphones to ears, characteristics from the headphones to a part near the ear or to an eardrum (ear canal transfer function ECTF; also referred to as ear canal transfer characteristics) are measured by microphones worn on listener's ears.

Japanese Unexamined Patent Application Publication No. 2018-191208 discloses an out-of-head localization filter determination device including headphones and a microphone unit. In Japanese Unexamined Patent Application Publication No. 2018-191208, a server device stores first preset data related to spatial acoustic transfer characteristics from a sound source to an ear of a person being measured and second preset data related to ear canal transfer characteristics of the ear of the person being measured in association with each other. A user terminal measures measurement data related to the ear canal transfer characteristics of the user. The user terminal transmits user data based on measurement data to the server device. The server device compares the user data with the plurality of pieces of second preset data. The server device extracts first preset data based on the comparison result.

Japanese Unexamined Patent Application Publication No. 2018-133708 discloses a sound pickup device capable of picking up measurement signals from headphones at an appropriate sound pickup position. For example, Japanese Unexamined Patent Application Publication No. 2018-133708 discloses the sound pickup device having a stethoscope-like structure.

When out-of-head localization processing is performed, characteristics are preferably measured by microphones placed on the listener's ears. Impulse response measurement (which is also referred to as "user measurement") and the like are executed in a state in which microphones are worn on the listener's ears. By using characteristics of the listener himself/herself, it is possible to generate a filter suitable for the listener.

That is, by performing user measurement, it is possible to appropriately measure the spatial acoustic transfer characteristics from the speaker to the ear canal. However, in order to perform user measurement, the user needs to go to a listening room or arrange a listening room at his/her home.

In a method disclosed in Japanese Unexamined Patent Application Publication No. 2018-191208, first preset data related to spatial acoustic transfer characteristics and second preset data related to ear canal transfer characteristics are associated with each other in a database. Then spatial acoustic transfer characteristics suitable for a user are extracted from the first preset data based on the ear canal transfer characteristics of an individual user. According to the method disclosed in Japanese Unexamined Patent Application Publication No. 2018-191208, it is possible to determine a filter without performing the user measurement of the spatial acoustic transfer characteristics.

It has been required to determine a filter for performing out-of-head localization processing more appropriately.

SUMMARY

An out-of-head localization filter determination system according to an embodiment includes: an output unit configured to be worn on a user and output sounds to an ear of the user; a microphone unit configured to be worn on the ear of the user and pick up the sounds output from the output unit; a measurement unit configured to output a measurement signal to the output unit and measure a sound pickup signal output from the microphone unit; a data storage unit configured to store first preset data related to spatial acoustic transfer characteristics from a sound source to an ear of a person being measured and second preset data related to ear canal transfer characteristics of the ear of the person being measured in association with each other, and store a plurality of first and second preset data acquired for a plurality of persons being measured; a frequency characteristics acquisition unit configured to convert the sound pickup signal into a frequency domain and acquire frequency characteristics; an extreme value extraction unit configured to extract a local maximum value and a local minimum value of the frequency characteristics; an envelope calculation unit configured to calculate first envelope data which is based on the local maximum value and second envelope data which is based on the local minimum value by interpolating each of the local maximum value and the local minimum value; a comparison unit configured to compare a user feature quantity which is based on the first and second envelope data with each of a plurality of feature quantities which are based on the plurality of pieces of second preset data; an extraction unit configured to extract the first preset data based on the comparison result in the comparison unit; and a determination unit configured to determine a filter in accordance with the first preset data that has been extracted.

An out-of-head localization filter determination method according to this embodiment is a method in a system. The system includes: an output unit configured to be worn on a user and output sounds to an ear of the user; a microphone unit configured to be worn on the ear of the user and pick up the sounds output from the output unit; a data storage unit configured to store first preset data related to spatial acoustic transfer characteristics from a sound source to an ear of a person being measured and second preset data related to ear canal transfer characteristics of the ear of the person being measured in association with each other, the data storage unit storing a plurality of pieces of first and second preset data acquired for a plurality of persons being measured. The method including: an output step for outputting a measurement signal to each output unit worn on the user; a signal acquisition step for acquiring a pickup signal when the measurement signal output from the output unit toward the user's ear is picked up by a microphone unit worn on the ear of the user; a frequency characteristics acquisition step for converting the sound pickup signal into a frequency domain and acquiring frequency characteristics; an extreme value extraction step for extracting a local maximum value and a local minimum value of the frequency characteristics; a calculation step for calculating first envelope data which is based on the local maximum value and second envelope data which is based on the local minimum value by interpolating each of the local maximum value and the local minimum value; a comparing step for comparing a user feature quantity which is based on the first and second envelope data with each of a plurality of feature quantities which are based on a plurality of pieces of second preset data; an extraction step for extracting the first preset data based on a comparison result in the comparing step; and a determination step for determining a filter in accordance with the extracted first preset data.

A program according to this embodiment is a program for causing a computer to execute an out-of-head localization filter determination method. The computer is able to access a data storage unit configured to store first preset data related to spatial acoustic transfer characteristics from a sound source to an ear of a person being measured and second preset data related to ear canal transfer characteristics of the ear of the person being measured in association with each other, the data storage unit storing a plurality of pieces of first and second preset data acquired for a plurality of persons being measured. The out-of-head localization filter determination method includes: an output step for outputting a measurement signal to each output unit worn on a user; a signal acquisition step for acquiring a pickup signal when the measurement signal output from the output unit toward the user's ear is picked up by a microphone unit worn on the ear of the user; a frequency characteristics acquisition step for converting the sound pickup signal into a frequency domain and acquiring frequency characteristics; an extreme value extraction step for extracting a local maximum value and a local minimum value of the frequency characteristics; a calculation step for calculating first envelope data which is based on the local maximum value and second envelope data which is based on the local minimum value by interpolating each of the local maximum value and the local minimum value; a comparing step for comparing a user feature quantity which is based on the first and second envelope data with each of a plurality of feature quantities which are based on a plurality of pieces of second preset data; an extraction step for extracting the first preset data based on a comparison result in the comparing step; and a determination step for determining a filter in accordance with the extracted first preset data.

According to the present disclosure, it is possible to provide an out-of-head localization filter determination system, an out-of-head localization filter determination method, and a program capable of appropriately determining a filter.

BRIEF DESCRIPTION OF THE DRAWINGS

The above and other aspects, advantages and features will be more apparent from the following description of certain embodiments taken in conjunction with the accompanying drawings, in which:

FIG. 9 is a table for describing first and second preset data stored in a data storage unit;

FIG. 10 is a table for describing clustered data;

FIG. 11 is a table for describing data when the first and second envelope data are separately clustered;

FIG. 12 is a table for describing data when the first and second envelope data are separately clustered;

DETAILED DESCRIPTION (Overview)

Figure 1:
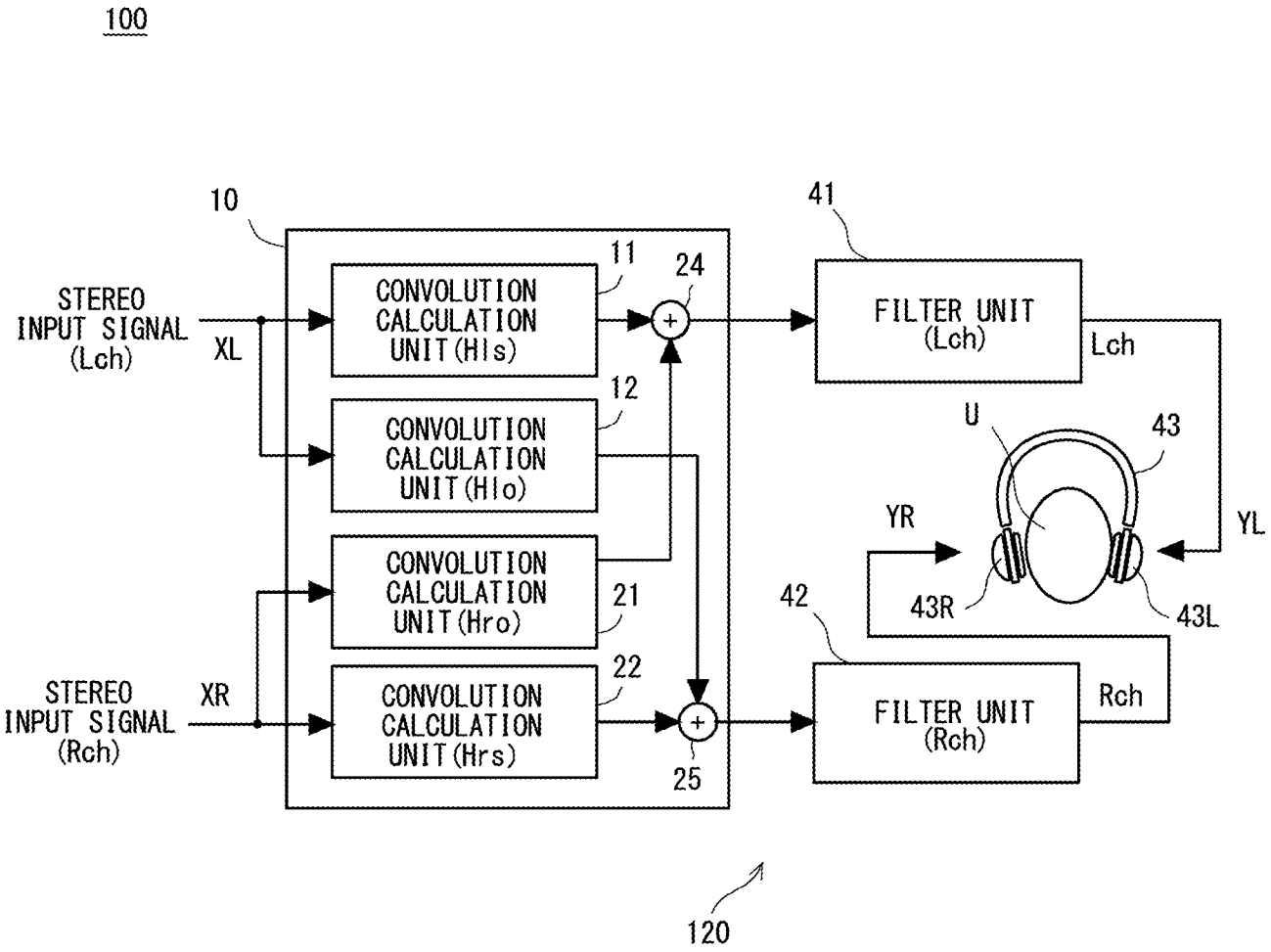
FIG. 1 is a block diagram showing an out-of-head localization device according to an embodiment.

The overview of sound localization processing is described hereinafter. Out-of-head localization, which is an example of a sound localization device, is described in the following example. The out-of-head localization processing according to this embodiment performs out-of-head localization by using spatial acoustic transfer characteristics and ear canal transfer characteristics. The spatial acoustic transfer characteristics are transfer characteristics from a sound source such as speakers to the ear canal. The ear canal transfer characteristics are transfer characteristics from the entrance of the ear canal to the eardrum. In this embodiment, out-of-head localization is implemented by measuring the ear canal transfer characteristics when headphones are worn and using this measurement data.

Out-of-head localization according to this embodiment is performed by a user terminal such as a personal computer (PC), a smartphone, or a tablet terminal. The user terminal is an information processor including processing means such as a processor, storage means such as a memory or a hard disk, display means such as a liquid crystal monitor, and input means such as a touch panel, a button, a keyboard and a mouse. The user terminal has a communication function to transmit and receive data. Further, output means (output unit) with headphones or earphones is connected to the user terminal.

To obtain high localization effect, it is necessary to measure the characteristics of a user and generate an out-of-head localization filter. The spatial acoustic transfer characteristics of an individual user are generally measured in a listening room where an acoustic device such as speakers and room acoustic characteristics are in good condition. Thus, a user needs to go to a listening room or arrange a listening room in the user's home or the like. Therefore, there are cases where the spatial acoustic transfer characteristics of an individual user cannot be measured appropriately.

Further, even when a listening room is arranged by placing speakers in a user's home or the like, there are cases where the speakers are placed in an asymmetric position or the acoustic environment of the room is not appropriate for listening to music. In such cases, it is extremely difficult to measure appropriate spatial acoustic transfer characteristics at home.

On the other hand, measurement of the ear canal transfer characteristics of an individual user is performed with a microphone unit and headphones being worn. In other words, the ear canal transfer characteristics can be measured as long as a user is wearing a microphone unit and headphones. Thus, a user does not need to go to a listening room or arrange a large-scale listening room in a user's home. Further, generation of measurement signals for measuring the ear canal transfer characteristics, recording of sound pickup signals and the like can be done using a user terminal such as a smartphone or a personal computer.

As described above, there are cases where it is difficult to carry out measurement of the spatial acoustic transfer characteristics on an individual user. In view of the above, an out-of-head localization system according to this embodiment determines a filter in accordance with the spatial acoustic transfer characteristics based on measurement results of the ear canal transfer characteristics. Specifically, this system determines an out-of-head localization filter suitable for a user based on measurement results of the ear canal transfer characteristics of an individual user.

To be specific, an out-of-head localization system includes a user terminal and a server device. The server device stores the spatial acoustic transfer characteristics and the ear canal transfer characteristics measured in advance on a plurality of persons being measured other than a user. Specifically, measurement of the spatial acoustic transfer characteristics using speakers as a sound source (which is hereinafter referred to also as first pre-measurement) and measurement of the ear canal transfer characteristics using headphones (which is hereinafter referred to also as second pre-measurement) are performed by using a measurement device different from a user terminal. The first pre-measurement and the second pre-measurement are performed on persons being measured other than a user.

The server device stores first preset data in accordance with results of the first pre-measurement and second preset data in accordance with results of the second pre-measurement. As a result of performing the first and second pre-measurement on a plurality of persons being measured, a plurality of pieces of first preset data and a plurality of pieces of second preset data are acquired. The server device then stores the first preset data related to the spatial acoustic transfer characteristics and the second preset data related to the ear canal transfer characteristics in association with each person being measured. The server device stores a plurality of pieces of first preset data and a plurality of pieces of second preset data in a database.

Further, for an individual user on which out-of-head localization is to be performed, only the ear canal transfer characteristics are measured by using a user terminal (which is described hereinafter as a user measurement). The user measurement is measurement using headphones as a sound source, just like in the case of the second pre-measurement. The user terminal acquires measurement data related to the ear canal transfer characteristics. The user terminal then transmits user data based on the measurement data to the server device. The server device compares the user data with the plurality of pieces of second preset data. Based on a comparison result, the server device determines second preset data having a strong correlation to the user data from the plurality of pieces of second preset data.

Then, the server device reads the first preset data associated with the second preset data having a strong correlation. In other words, the server device extracts the first preset data suitable for an individual user from the plurality of pieces of first preset data based on a comparison result. The server device transmits the extracted first preset data to the user terminal. Then, the user terminal performs out-of-head localization based on a filter based on the first preset data and an inverse filter based on the user measurement.

(Out-of-Head Localization Device)

FIG. 1 shows an out-of-head localization device 100, which is an example of a sound field reproduction device according to this embodiment. FIG. 1 is a block diagram of the out-of-head localization device 100. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are analog audio reproduced signals that are output from a Compact Disc (CD) player or the like or digital audio data such as MPEG Audio Layer-3 (mp3). Note that the out-of-head localization device 100 is not limited to a physically single device, and a part of processing may be performed in a different device. For example, a part of processing may be performed by a PC or the like, and the rest of processing may be performed by a Digital Signal Processor (DSP) included in the headphones 43 or the like.

The out-of-head localization device 100 includes an out-of-head localization unit 10, a filter unit 41, a filter unit 42, and headphones 43. The out-of-head localization unit 10, the filter unit 41 and the filter unit 42 constitute an arithmetic processing unit 120, which is described later, and they can be implemented by a processor or the like, to be specific.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves a filter of the spatial acoustic transfer characteristics (which is referred hereinafter also as a spatial acoustic filter) into each of the stereo input signals XL and XR having the respective channels. The spatial acoustic transfer characteristics may be a head-related transfer function HRTF measured in the head or auricle of a measured person, or may be the head-related transfer function of a dummy head or a third person.

The spatial acoustic transfer function is a set of four spatial acoustic transfer characteristics Hls, Hlo, Hro and Hrs. Data used for convolution in the convolution calculation units 11 to 12 and 21 to 22 is a spatial acoustic filter.

Each of the spatial acoustic transfer characteristics Hls, Hlo, Hro and Hrs is measured using a measurement device, which is described later.

The convolution calculation unit 11 convolves the spatial acoustic filter in accordance with the spatial acoustic transfer characteristics Hls to the L-ch stereo input signal XL. The convolution calculation unit 11 outputs convolution calculation data to the adder 24. The convolution calculation unit 21 convolves the spatial acoustic filter in accordance with the spatial acoustic transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the spatial acoustic filter in accordance with the spatial acoustic transfer characteristics Hlo to the L-ch stereo input signal XL. The convolution calculation unit 12 outputs convolution calculation data to the adder 25. The convolution calculation unit 22 convolves the spatial acoustic filter in accordance with the spatial acoustic transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels out the headphone characteristics (characteristics between a reproduction unit of headphones and a microphone) is set to the filter units 41 and 42. Then, the inverse filter is convolved to the reproduced signals (convolution calculation signals) on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels out the characteristics from the headphone unit to the microphone when the headphones 43 are worn. The microphone may be placed at any position between the entrance of the ear canal and the eardrum. The inverse filter is calculated from a result of measuring the characteristics of the user U.

The filter unit 41 outputs the processed L-ch signal to a left unit 43L of the headphones 43. The filter unit 42 outputs the processed R-ch signal to a right unit 43R of the headphones 43. The user U is wearing the headphones 43. The headphones 43 output the L-ch signal and the R-ch signal toward the user U. It is thereby possible to reproduce sound images localized outside the head of the user U.

As described above, the out-of-head localization device 100 performs out-of-head localization by using the spatial acoustic filters in accordance with the spatial acoustic transfer characteristics Hls, Hlo, Hro and Hrs and the inverse filters of the headphone characteristics. In the following description, the spatial acoustic filters in accordance with the spatial acoustic transfer characteristics Hls, Hlo, Hro and Hrs and the inverse filter of the headphone characteristics are referred to collectively as an out-of-head localization filter. In the case of 2ch stereo reproduced signals, the out-of-head localization filter is composed of four spatial acoustic filters and two inverse filters. The out-of-head localization device 100 then carries out convolution calculation on the stereo reproduced signals by using the total six out-of-head localization filters and thereby performs out-of-head localization.

(Measurement Device of Spatial Acoustic Transfer Characteristics)

Figure 2:
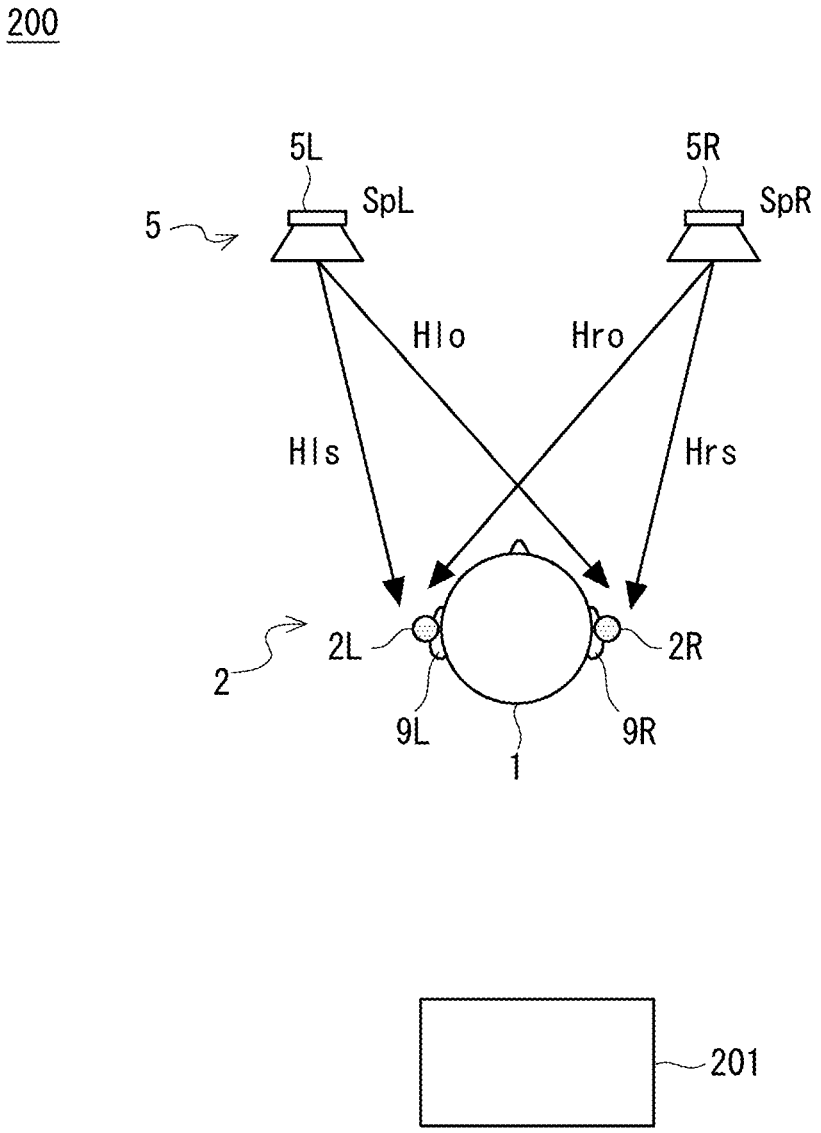
FIG. 2 is a view showing a structure of a measurement device for measuring spatial acoustic transfer characteristics.

A measurement device 200 for measuring the spatial acoustic transfer characteristics Hls, Hlo, Hro and Hrs is described hereinafter with reference to FIG. 2. FIG. 2 is a view schematically showing a measurement structure for performing the first pre-measurement on a person 1 being measured.

As shown in FIG. 2, the measurement device 200 includes a stereo speaker 5 and a microphone unit 2. The stereo speaker 5 is placed in a measurement environment. The measurement environment may be the user U's room at home, a dealer or showroom of an audio system or the like. The measurement environment is preferably a listening room where speakers and acoustics are in good condition.

In this embodiment, a measurement processor 201 of the measurement device 200 performs processing for appropriately generating the spatial acoustic filter. The measurement processor 201 includes a music player such as a CD player, for example. The measurement processor 201 may be a personal computer (PC), a tablet terminal, a smartphone or the like. Further, the measurement processor 201 may be a server device.

The stereo speaker 5 includes a left speaker 5L and a right speaker 5R. For example, the left speaker 5L and the right speaker 5R are placed in front of the person 1 being measured. The left speaker 5L and the right speaker 5R output impulse sounds for impulse response measurement and the like. Although the number of speakers, which serve as sound sources, is 2 (stereo speakers) in this embodiment, the number of sound sources to be used for measurement is not limited to 2, and it may be any number equal to or larger than 1. Therefore, this embodiment is applicable also to 1ch mono or 5.1ch, 7.1ch etc. multichannel environment.

The microphone unit 2 is stereo microphones including a left microphone 2L and a right microphone 2R. The left microphone 2L is placed on a left ear 9L of the person 1 being measured, and the right microphone 2R is placed on a right ear 9R of the person 1 being measured. To be specific, the microphones 2L and 2R are preferably placed at a position between the entrance of the ear canal and the eardrum of the left ear 9L and the right ear 9R, respectively. The microphones 2L and 2R pick up measurement signals output from the stereo speaker 5 and acquire sound pickup signals. The microphones 2L and 2R output the sound pickup signals to the measurement processor 201. The person 1 being measured may be a person or a dummy head. In other words, in this embodiment, the person 1 being measured is a concept that includes not only a person but also a dummy head.

As described above, impulse sounds output from the left and right speakers 5L and 5R are measured using the microphones 2L and 2R, respectively, and thereby impulse response is measured. The measurement processor 201 stores the sound pickup signals acquired by the impulse response measurement into a memory or the like. The spatial acoustic transfer characteristics Hls between the left speaker 5L and the left microphone 2L, the spatial acoustic transfer characteristics Hlo between the left speaker 5L and the right microphone 2R, the spatial acoustic transfer characteristics Hro between the right speaker 5R and the left microphone 2L, and the spatial acoustic transfer characteristics Hrs between the right speaker 5R and the right microphone 2R are thereby measured. Specifically, the left microphone 2L picks up the measurement signal that is output from the left speaker 5L, and thereby the spatial acoustic transfer characteristics Hls are acquired. The right microphone 2R picks up the measurement signal that is output from the left speaker 5L, and thereby the spatial acoustic transfer characteristics Hlo are acquired. The left microphone 2L picks up the measurement signal that is output from the right speaker 5R, and thereby the spatial acoustic transfer characteristics Hro are acquired. The right microphone 2R picks up the measurement signal that is output from the right speaker 5R, and thereby the spatial acoustic transfer characteristics Hrs are acquired.

Further, the measurement device 200 may generate the spatial acoustic filters in accordance with the spatial acoustic transfer characteristics Hls, Hlo, Hro, and Hrs from the left and right speakers 5L and 5R to the left and right microphones 2L and 2R based on the sound pickup signals. For example, the measurement processor 201 cuts out the spatial acoustic transfer characteristics Hls, Hlo, Hro, and Hrs with a specified filter length. The measurement processor 201 may correct the measured spatial acoustic transfer characteristics Hls, Hlo, Hro, and Hrs.

In this manner, the measurement processor 201 generates the spatial acoustic filter to be used for convolution calculation of the out-of-head localization device 100. As shown in FIG. 1, the out-of-head localization device 100 performs out-of-head localization processing by using the spatial acoustic filters in accordance with the spatial acoustic transfer characteristics Hls, Hlo, Hro, and Hrs between the left and right speakers 5L and 5R and the left and right microphones 2L and 2R. Specifically, the out-of-head localization processing is performed by convolving the spatial acoustic filters to the audio reproduced signals.

The measurement processor 201 performs the same processing on the sound pickup signals that correspond to the respective spatial acoustic transfer characteristics Hls, Hlo, Hro, and Hrs. Specifically, the same processing is performed on each of the four sound pickup signals that correspond to the spatial acoustic transfer characteristics Hls, Hlo, Hro, and Hrs. The spatial acoustic filters that respectively correspond to the spatial acoustic transfer characteristics Hls, Hlo, Hro, and Hrs are thereby generated.

(Measurement of Ear Canal Transfer Characteristics)

Figure 3:
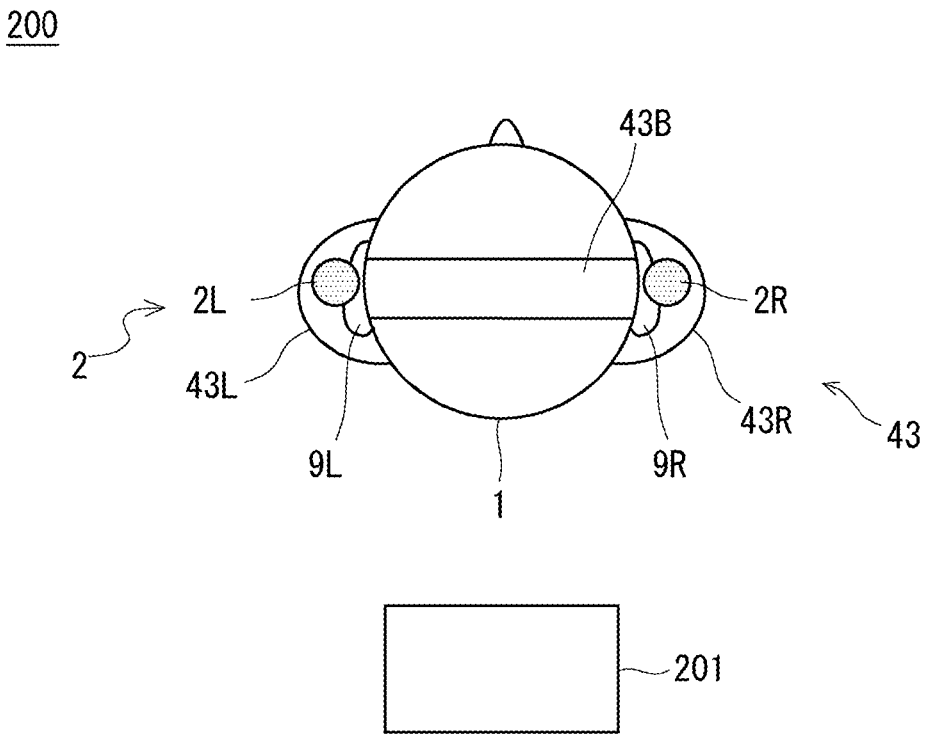
FIG. 3 is a view showing a structure of a measurement device for measuring ear canal transfer characteristics.

Referring next to FIG. 3, a measurement device 200 for measuring the ear canal transfer characteristics will be described. FIG. 3 shows a structure for performing the second pre-measurement on a person 1 being measured.

A microphone unit 2 and headphones 43 are connected to a measurement processor 201. The microphone unit 2 includes a left microphone 2L and a right microphone 2R. The left microphone 2L is worn on a left ear 9L of the person 1 being measured, and the right microphone 2R is worn on a right ear 9R of the person 1 being measured. The measurement processor 201 and the microphone unit 2 may be the same as or different from the measurement processor 201 and the microphone unit 2 in FIG. 2, respectively.

The headphones 43 include a headphone band 43B, a left unit 43L, and a right unit 43R. The headphone band 43B connects the left unit 43L and the right unit 43R. The left unit 43L outputs a sound toward the left ear 9L of the person 1 being measured. The right unit 43R outputs a sound toward the right ear 9R of the person 1 being measured. The type of the headphones 43 may be closed, open, semi-open, semi-closed or any other type. The headphones 43 are worn on the person 1 being measured while the microphone unit 2 is worn on this person. Specifically, the left unit 43L and the right unit 43R of the headphones 43 are worn on the left ear 9L and the right ear 9R on which the left microphone 2L and the right microphone 2R are worn, respectively. The headphone band 43B generates an urging force to press the left unit 43L and the right unit 43R against the left ear 9L and the right ear 9R, respectively.

The left microphone 2L picks up the sound output from the left unit 43L of the headphones 43. The right microphone 2R picks up the sound output from the right unit 43R of the headphones 43. A microphone part of each of the left microphone 2L and the right microphone 2R is placed at a sound pickup position near the external acoustic opening. The left microphone 2L and the right microphone 2R are formed not to interfere with the headphones 43. Specifically, the person 1 being measured can wear the headphones 43 in the state where the left microphone 2L and the right microphone 2R are placed at appropriate positions of the left ear 9L and the right ear 9R, respectively. The left microphone 2L and the right microphone 2R are respectively included in the left unit 43L and the right unit 43R of the headphones 43. For example, the left microphone 2L is fixed in the housing of the left unit 43L and the right microphone 2R is fixed in the housing of the right unit 43R. As a matter of course, the left microphone 2L and the right microphone 2R may be provided separately from the headphones 43.

The measurement processor 201 outputs measurement signals to the left microphone 2L and the right microphone 2R. The left microphone 2L and the right microphone 2R thereby generate impulse sounds or the like. To be specific, an impulse sound output from the left unit 43L is measured by the left microphone 2L. An impulse sound output from the right unit 43R is measured by the right microphone 2R. Impulse response measurement is performed in this manner.

The measurement processor 201 stores the sound pickup signals acquired based on the impulse response measurement into a memory or the like. The transfer characteristics between the left unit 43L and the left microphone 2L (which is the ear canal transfer characteristics of the left ear) and the transfer characteristics between the right unit 43R and the right microphone 2R (which is the ear canal transfer characteristics of the right ear) are thereby acquired. Measurement data of the ear canal transfer characteristics of the left ear acquired by the left microphone 2L is referred to as measurement data ECTFL, and measurement data of the ear canal transfer characteristics of the right ear acquired by the right microphone 2R is referred to as measurement data ECTFR.

The measurement processor 201 includes a memory or the like that stores the measurement data ECTFL and ECTFR. Note that the measurement processor 201 generates an impulse signal, a Time Stretched Pulse (TSP) signal or the like as the measurement signal for measuring the ear canal transfer characteristics and the spatial acoustic transfer characteristics. The measurement signal contains a measurement sound such as an impulse sound.

By the measurement devices 200 shown in FIGS. 2 and 3, the ear canal transfer characteristics and the spatial acoustic transfer characteristics of a plurality of persons 1 being measured are measured. In this embodiment, the first pre-measurement by the measurement structure in FIG. 2 is performed on a plurality of persons 1 being measured. Likewise, the second pre-measurement by the measurement structure in FIG. 3 is performed on the plurality of persons 1 being measured. The ear canal transfer characteristics and the spatial acoustic transfer characteristics are thereby measured for each of the persons 1 being measured.

(Out-of-Head Localization Filter Determination System)

Figure 4:
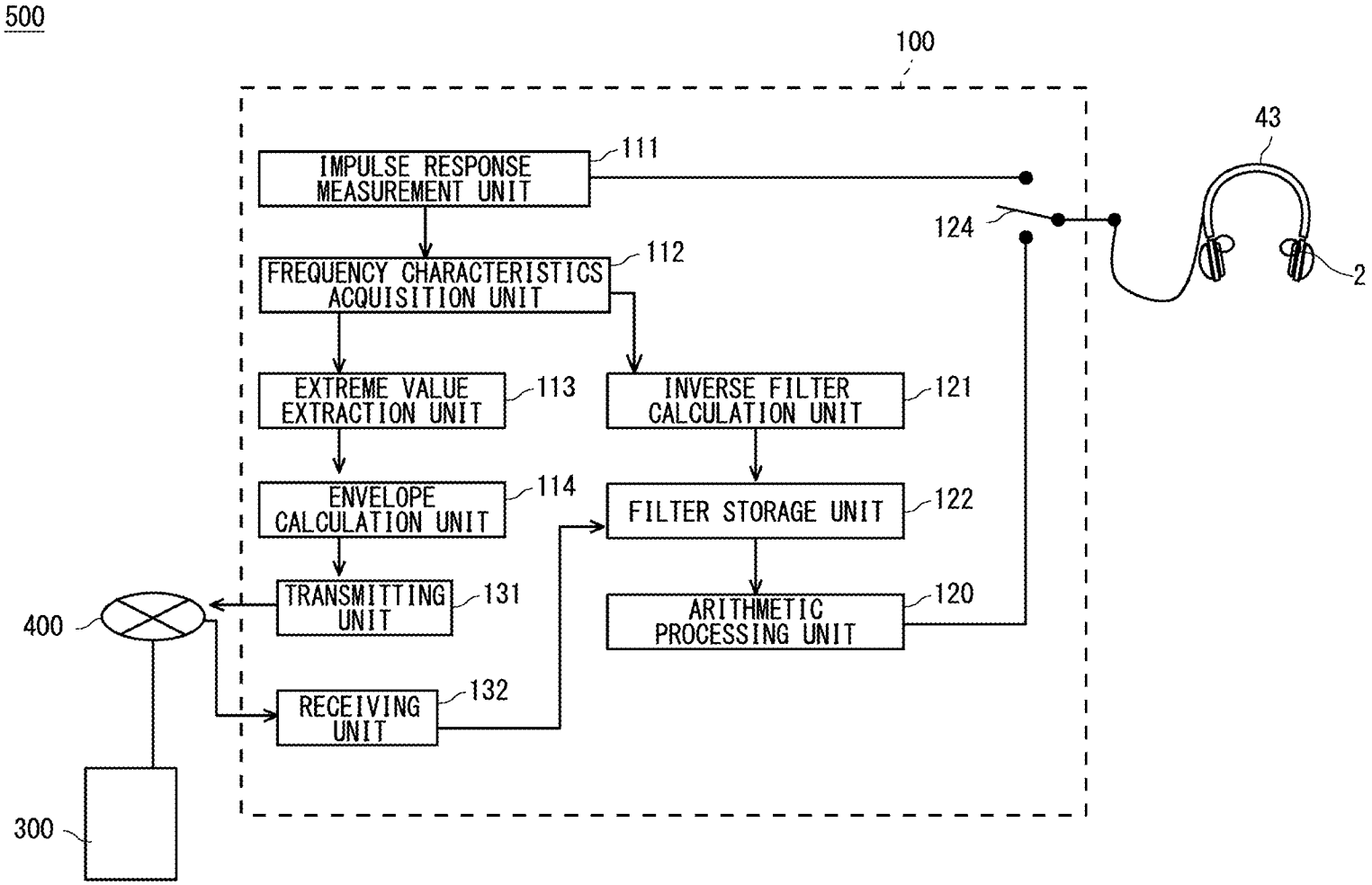
FIG. 4 is a view showing the overall structure of an out-of-head localization filter determination system according to this embodiment.

An out-of-head localization filter determination system 500 according to this embodiment is described hereinafter with reference to FIG. 4. FIG. 4 is a view showing the overall structure of the out-of-head localization filter determination system 500. The out-of-head localization filter determination system 500 includes a microphone unit 2, headphones 43, an out-of-head localization device 100, and a server device 300.

The out-of-head localization device 100 and the server device 300 are connected to each other through a network 400. The network 400 is a public network such as the Internet or a mobile phone communication network, for example. The out-of-head localization device 100 and the server device 300 can communicate with each other by wireless or wired. Note that the out-of-head localization device 100 and the server device 300 may be an integral device.

The out-of-head localization device 100 is a user terminal that outputs a reproduced signal on which out-of-head localization has been performed to the user U, as shown in FIG. 1. Further, the out-of-head localization device 100 performs measurement of the ear canal transfer characteristics of the user U. The microphone unit 2 and the headphones 43 are connected to the out-of-head localization device 100. The out-of-head localization device 100 performs impulse response measurement using the microphone unit 2 and the headphones 43, just like the measurement device 200 in FIG. 3. Note that the out-of-head localization device 100 may be connected to the microphone unit 2 and the headphones 43 wirelessly by Bluetooth (registered trademark) or the like.

The out-of-head localization device 100 includes an impulse response measurement unit 111, a frequency characteristics acquisition unit 112, an extreme value extraction unit 113, an envelope calculation unit 114, a transmitting unit 131, a receiving unit 132, an arithmetic processing unit 120, an inverse filter calculation unit 121, a filter storage unit 122, and a switch 124. Note that, when the out-of-head localization device 100 and the server device 300 are an integral device, this device may include an acquisition unit that acquires user data in place of the receiving unit 132.

The switch 124 switches user measurement and out-of-head localization reproduction. Specifically, for user measurement, the switch 124 connects the headphones 43 to the impulse response measurement unit 111. For out-of-head localization reproduction, the switch 124 connects the headphones 43 to the arithmetic processing unit 120.

First, processing for obtaining the inverse filter of the ear canal transfer characteristics will be described. The impulse response measurement unit 111 outputs measurement signals, which are impulse sounds, to the headphones 43 in order to perform user measurement. The microphone unit 2 picks up the impulse sounds output from the headphones 43. In this example, the microphone unit 2 is included in the headphones 43. Further, the microphone unit 2 may be detachably attached to the headphones 43.

The microphone unit 2 outputs sound pickup signals to the impulse response measurement unit 111. Since the impulse response measurement is similar to that in the description with reference to FIG. 3, the description thereof is omitted as appropriate. That is, the out-of-head localization device 100 has similar functions as those of the measurement processor 201 in FIG. 3. The out-of-head localization device 100, the microphone unit 2, and the headphones 43 form a measurement device that performs user measurement. The impulse response measurement unit 111 may perform A/D conversion, synchronous addition and the like of the sound pickup signals.

By the impulse response measurement, the impulse response measurement unit 111 acquires the measurement data ECTF related to the ear canal transfer characteristics. The measurement data ECTF contains measurement data ECTFL related to the ear canal transfer characteristics of the left ear 9L of the user U and the measurement data ECTFR related to the ear canal transfer characteristics of the right ear 9R of the user U.

The frequency characteristics acquisition unit 112 performs specified processing on the measurement data ECTFL and ECTFR and thereby acquires the frequency characteristics of the measurement data ECTFL and ECTFR. For example, the frequency characteristics acquisition unit 112 calculates frequency-amplitude characteristics and frequency-phase characteristics by performing discrete Fourier transform. Further, the frequency characteristics acquisition unit 112 may calculate frequency-amplitude characteristics and frequency-phase characteristics by means for converting a discrete signal into a frequency domain such as discrete cosine transform, instead of performing discrete Fourier transform. Instead of the frequency-amplitude characteristics, frequency-power characteristics may be used.

The inverse filter calculation unit 121 calculates an inverse filter based on the frequency characteristics of the ear canal transfer characteristics. For example, the inverse filter calculation unit 121 corrects the frequency-amplitude characteristics and the frequency-phase characteristics of the measurement data ECTFL and ECTFR. The inverse filter calculation unit 121 calculates inverse characteristics so as to cancel out amplitude spectra of the ear canal transfer characteristics ECTFL and ECTFR. The inverse characteristics are amplitude spectra having filter coefficients that cancel out logarithmic amplitude spectra.

The inverse filter calculation unit 121 calculates signals in the time domain from the inverse characteristics and the phase characteristics by inverse discrete Fourier transform or inverse discrete cosine transform. The inverse filter calculation unit 121 generates a temporal signal by performing inverse fast Fourier transform (IFFT) on the inverse characteristics and the phase characteristics. The inverse filter calculation unit 121 calculates an inverse filter by cutting out the generated temporal signal with a specified filter length. The inverse filter calculation unit 121 generates inverse filters Linv and Rinv by performing similar processing on the sound pickup signals from the microphones 2L and 2R. Since a known method can be used as the processing for obtaining the inverse filters, the detailed description thereof will be omitted.

As described above, the inverse filter is a filter that cancels out headphone characteristics (characteristics between a reproduction unit of headphones and a microphone). The filter storage unit 122 stores left and right inverse filters calculated by the inverse filter calculation unit 121. Accordingly, the inverse filters Linv and Rinv are set in the filter units 41 and 42 shown in FIG. 1.

Next, processing for determining the spatial acoustic filter regarding the spatial acoustic transfer characteristics Hls, Hlo, Hro, and Hrs will be described.

The frequency characteristics acquired in the frequency characteristics acquisition unit 112 are input to the extreme value extraction unit 113. Specifically, the frequency characteristics acquisition unit 112 smooths the frequency-amplitude characteristics and then outputs the smoothed frequency-amplitude characteristics to the extreme value extraction unit 113. Alternatively, the extreme value extraction unit 113 may smooth the frequency-amplitude characteristics.

Figure 5:
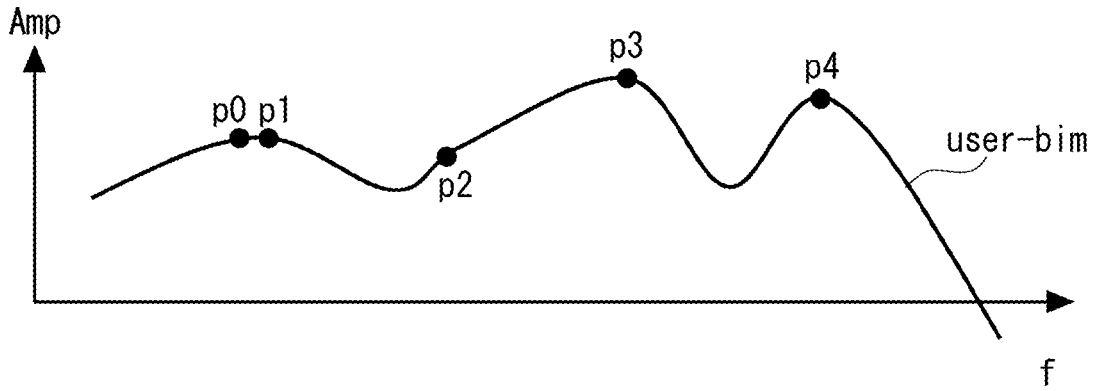
FIG. 5 is a view for describing processing of extracting local maximum values in an extreme value extraction unit.

The extreme value extraction unit 113 extracts extreme values of the frequency characteristics. The extreme value extraction unit 113 extracts a plurality of local maximum values and a plurality of local minimum values. FIG. 5 is a view for describing processing of extracting local maximum values by the extreme value extraction unit 113. In FIG. 5, the horizontal axis indicates a frequency and the vertical axis indicates amplitude.

FIG. 5 shows smoothed frequency-amplitude characteristics as frequency characteristics user-bim. The frequency-amplitude characteristics user-bim includes five local maximum values p0-p4. The extreme value extraction unit 113 may extract all the local maximum values p0-p4 or may thin out some of these values. When the distance between frequency positions of two points of the extreme values is below a desired threshold, an extreme value whose value of amplitude is larger is left and an extreme value whose value of amplitude is smaller is thinned out. For example, the distance between frequency positions of the first local maximum value p0 and the second local maximum value pl is small. Therefore, the local maximum value p1, which is smaller than the local maximum value p0, is thinned out. In this case, the extreme value extraction unit 113 extracts four local maximum values p0 and p2-p4. Likewise, the extreme value extraction unit 113 extracts a plurality of local minimum values. The extreme value extraction unit 113 stores the frequencies and values of amplitude of the extracted extreme values.

The envelope calculation unit 114 calculates envelopes based on the local maximum values and the local minimum values, respectively. Data of the envelope calculated based on the local maximum values is referred to as first envelope data user-bim_max and data of the envelope calculated based on the local minimum values is referred to as second envelope data user-bim_min.

For example, data obtained by performing polynomial interpolation such as spline interpolation on a plurality of local maximum values by the envelope calculation unit 114 is first envelope data user-bim_max. Data obtained by performing polynomial interpolation such as spline interpolation on a plurality of local minimum values by the envelope calculation unit 114 is second envelope data user-bim_min. As a matter of course, the calculation of the envelopes is not limited to polynomial interpolation such as spline interpolation. The envelope calculation unit 114 may interpolate the first envelope data user-bim_max and the second envelope data user-bim_min using one polynomial or by different expressions. The envelope calculation unit 114 may extrapolate the first envelope data user-bim_max and the second envelope data user-bim_min.

Figure 6:
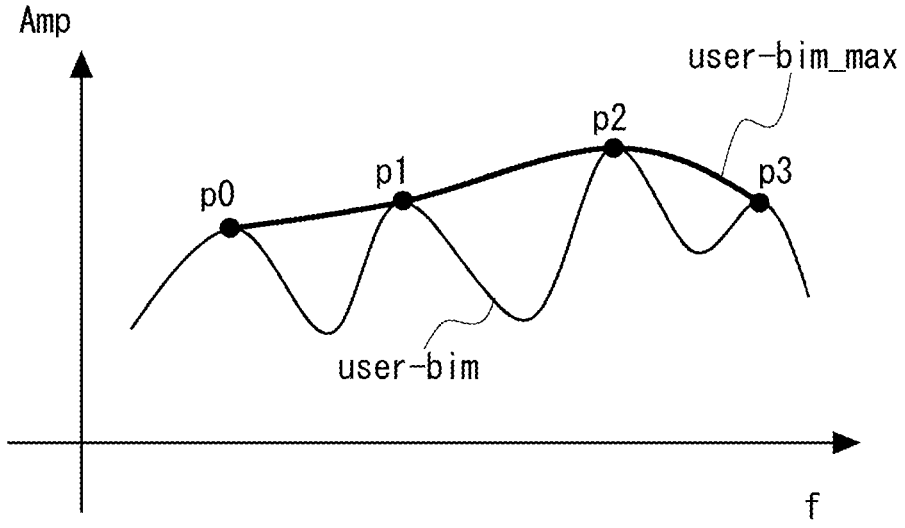
FIG. 6 is a view showing first envelope data calculated from local maximum values.
Figure 7:
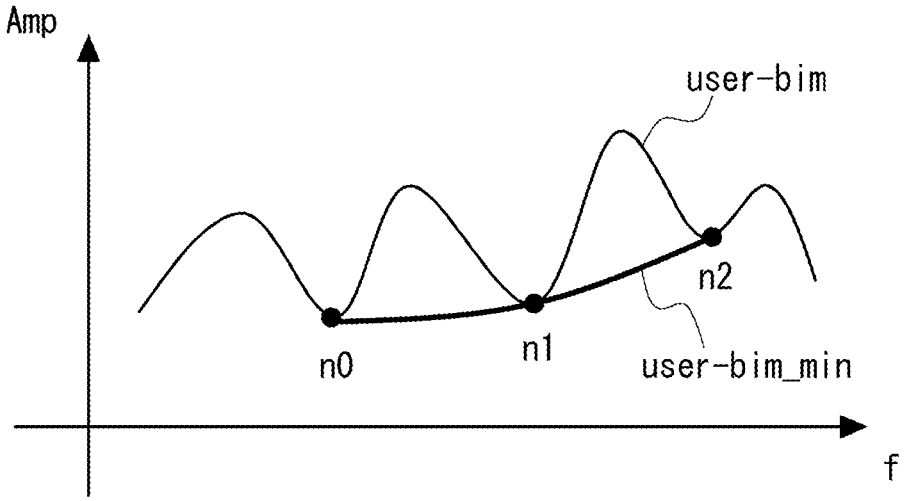
FIG. 7 is a view showing second envelope data calculated from local minimum values.

FIG. 6 is a view showing the first envelope data user-bim_max calculated based on local maximum values p0-p3 of the frequency characteristics user-bim. FIG. 7 is a schematic view showing the second envelope data user-bim_min calculated based on local minimum values n0-n2 of the frequency characteristics user-bim.

As described above, the envelope calculation unit 114 calculates each of the envelope data of the local maximum values and the envelope data of the local minimum values. Accordingly, the first envelope data user-bim_max based on the local maximum values and the second envelope data user-bim_min based on the local minimum values are calculated. The first envelope data user-bim_max and the second envelope data user-bim_min are user feature quantities indicating features of the ear canal transfer characteristics of the user.

For example, the first envelope data user-bim_max and the second envelope data user-bim_min are a set of amplitude values for each frequency. That is, the first envelope data user-bim_max and the second envelope data user-bim_min are shown as multidimensional vectors including a plurality of amplitude values. While the first envelope data user-bim_max and the second envelope data user-bim_min are in vector form with the same number of dimensions, they may be in vector form with different numbers of dimensions.

The transmitting unit 131 transmits, as user data (user feature quantities), the first envelope data user-bim_max and the second envelope data user-bim_min to the server device 300. The transmitting unit 131 performs processing (for example, modulation) in accordance with a communication standard on the user data and transmits the obtained data. Note that the transmitting unit 131 may transmit, as the user data, amplitude values forming the first envelope data user-bim_max and the second envelope data user-bim_min. Alternatively, the transmitting unit 131 may transmit extreme values and coefficients of an approximate expression obtained by polynomial interpolation as the user data.

Figure 8:
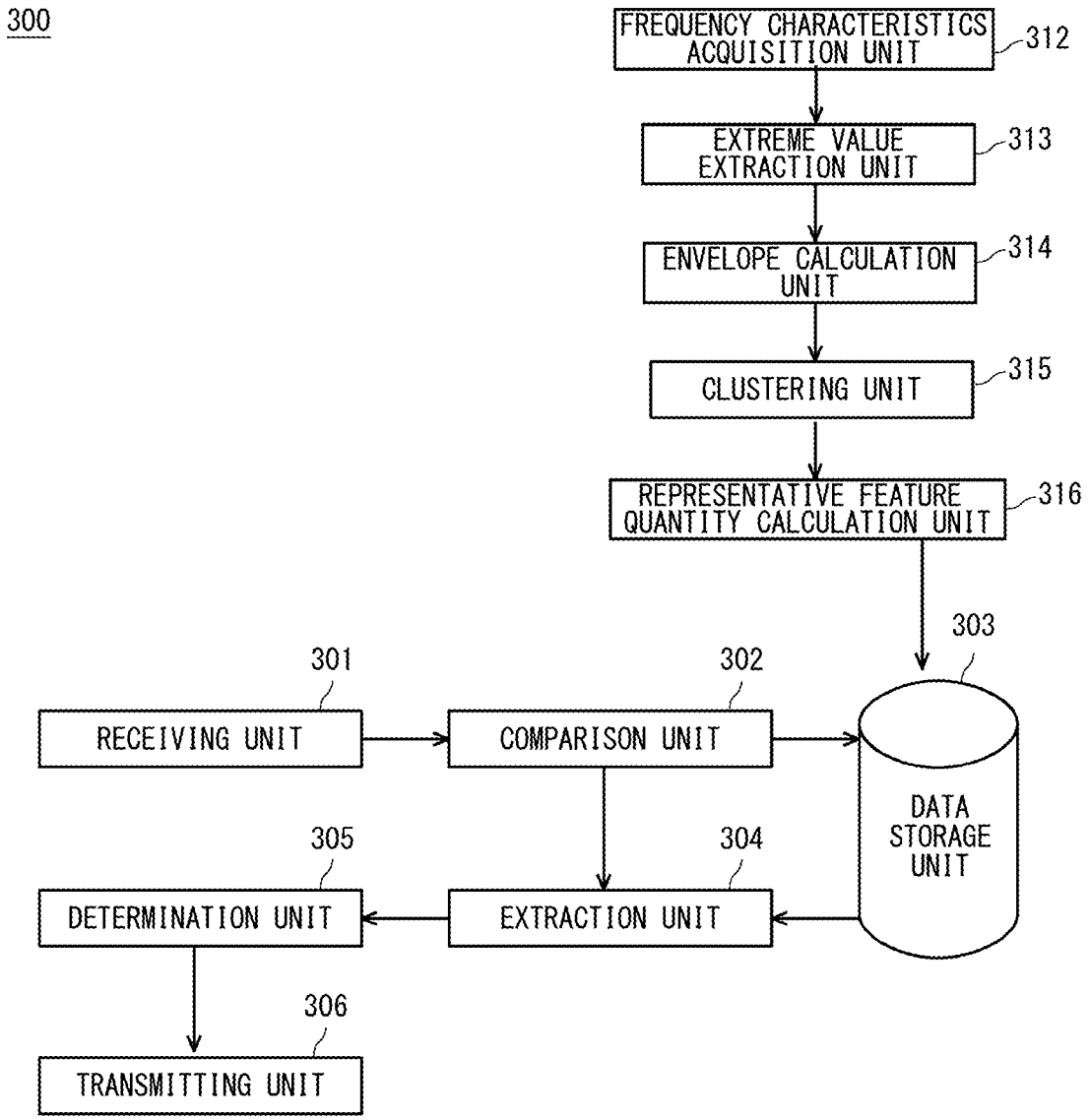
FIG. 8 is a block diagram showing a structure of a server device.

Referring next to FIG. 8, a configuration of the server device 300 will be described. FIG. 8 is a block diagram showing a control structure of the server device 300. The server device 300 includes a receiving unit 301, a comparison unit 302, a data storage unit 303, an extraction unit 304, a determination unit 305, and a transmitting unit 306. The server device 300 serves as a filter determination device that determines a spatial acoustic filter based on the user data. When the out-of-head localization device 100 and the server device 300 are an integral device, this device may not include the transmitting unit 306 and the like.

The server device 300 further includes a frequency characteristics acquisition unit 312, an extreme value extraction unit 313, an envelope calculation unit 314, a clustering unit 315, and a representative feature quantity calculation unit 316.

The server device 300 is a computer including a processor, a memory and the like, and performs the following processing according to a program. Further, the server device 300 is not limited to a single device, and it may be implemented by combining two or more devices, or may be a virtual server such as a cloud server. The data storage unit 303 that stores data, and the comparison unit 302, the determination unit 305 and the like that perform data processing may be physically separate devices.

The data storage unit 303 is a database that stores, as preset data, data related to a plurality of persons being measured obtained by pre-measurement. The data stored in the data storage unit 303 is described hereinafter with reference to FIG. 9. FIG. 9 is a table showing the data stored in the data storage unit 303.

The data storage unit 303 stores preset data for each of the left and right ears of a person being measured. To be specific, the data storage unit 303 is in table format where ID of person being measured, left/right of ear, first envelope data, second envelope data, ear canal transfer characteristics, spatial acoustic transfer characteristics 1, and spatial acoustic transfer characteristics 2 are arranged in one row. Note that the data format shown in FIG. 9 is an example, and a data format where objects of each parameter are stored in association by tag or the like may be used instead of the table format.

Two data sets are stored for one person A being measured in the data storage unit 303. Specifically, a data set related to the left ear of the person A being measured and a data set related to the right ear of the person A being measured are stored in the data storage unit 303.

One data set contains ID of person being measured, left/right of ear, first envelope data, second envelope data, ear canal transfer characteristics, spatial acoustic transfer characteristics 1, and spatial acoustic transfer characteristics 2. The ear canal transfer characteristics are data based on the second pre-measurement by the measurement device 200 shown in FIG. 3. The ear canal transfer characteristics are the frequency-amplitude characteristics of the first ear canal transfer characteristics from a first position, which is located anterior to the external acoustic opening, to the microphones 2L and 2R.

The ear canal transfer characteristics of the left ear of the person A being measured are denoted by ear canal transfer characteristics ECTFL_A and the ear canal transfer characteristics of the right ear of the person A being measured are denoted by ear canal transfer characteristics ECTFR_A. The ear canal transfer characteristics of the left ear of the person B being measured are denoted by ear canal transfer characteristics ECTFL_B and the ear canal transfer characteristics of the right ear of the person B being measured are denoted by ear canal transfer characteristics ECTFR_B. While the headphones 43 used for the user measurement and those used for the second pre-measurement are preferably of the same type, they may be of different types.

The spatial acoustic transfer characteristics 1 and the spatial acoustic transfer characteristics 2 are data based on the first pre-measurement by the measurement device 200 shown in FIG. 2. In the case of the left ear of the person A being measured, the spatial acoustic transfer characteristics 1 are Hls_A and the spatial acoustic transfer characteristics 2 are Hro_A. In the case of the right ear of the person A being measured, the spatial acoustic transfer characteristics 1 are Hrs_A and the spatial acoustic transfer characteristics 2 are Hlo_A. In this manner, two spatial acoustic transfer characteristics for one ear are paired. For the left ear of the person B being measured, Hls_B and Hro_B are paired, and for the right ear of the person B being measured, Hrs_B and Hlo_B are paired. The spatial acoustic transfer characteristics 1 and the spatial acoustic transfer characteristics 2 may be data after being cut out with a filter length or may be data before being cut out with a filter length.

The first envelope data and the second envelope data are similar to the first envelope data user-bim_max and the second envelope data user-bim_min obtained in the envelope calculation unit 114.

Specifically, the frequency characteristics acquisition unit 312 acquires the frequency characteristics of the ear canal transfer characteristics ECTFL_A. In this example, the frequency characteristics acquisition unit 312 calculates the smoothed frequency-amplitude characteristics as frequency characteristics. The extreme value extraction unit 313 extracts local maximum values and local minimum values of the frequency characteristics. The envelope calculation unit 314 calculates the first envelope data AL_bim_max based on local maximum values and the second envelope data AL_bim_min based on local minimum values. The first envelope data AL_bim_max and the second envelope data AL_bim_min are feature quantities indicating the features of the ear canal transfer characteristics ECTFL_A of the left ear of the person A being measured.

Since the processing of the frequency characteristics acquisition unit 312, the extreme value extraction unit 313, and the envelope calculation unit 314 are similar to the processing of the frequency characteristics acquisition unit 112, the extreme value extraction unit 113, and the envelope calculation unit 114, the description thereof is omitted as appropriate. Note that the smoothing processing in the frequency characteristics acquisition unit 312 and the interpolation processing in the envelope calculation unit 314 are preferably processing using expressions similar to those used in the smoothing processing in the frequency characteristics acquisition unit 112 and the interpolation processing in the envelope calculation unit 114.

The frequency characteristics acquisition unit 312, the extreme value extraction unit 313, and the envelope calculation unit 314 perform similar processing on the ear canal transfer characteristics ECTFR_A and the like. In this manner, for each of the ear canal transfer characteristics, the first and second envelope data are calculated. The data storage unit 303 stores the first and second envelope data in association with the ear canal transfer characteristics.

At least a part of the processing in the frequency characteristics acquisition unit 312, the extreme value extraction unit 313, and the envelope calculation unit 314 may be performed in the measurement processor 201 shown in FIG. 3. That is, processing for calculating the first and second envelope data may be performed in the measurement processor 201. For example, the measurement processor 201 may extract local maximum values and local minimum values from the smoothed frequency-amplitude characteristics and transmit the local maximum values and the local minimum values to the server device 300 along with the ear canal transfer characteristics.

Alternatively, the measurement processor 201 may calculate the first and second envelope data and transmit the first and second envelope data to the server device 300. In this case, in the server device 300, the frequency characteristics acquisition unit 312, the extreme value extraction unit 313, and the envelope calculation unit 314 are unnecessary. Furthermore, the processing for calculating the first and second envelope data may be performed by a device other than the server device 300 and the measurement processor 201.

For the left ear of the person A being measured, the first envelope data AL_bim_max, the second envelope data AL_bim_min, the ear canal transfer characteristics ECTFL_A, the spatial acoustic transfer characteristics Hls_A, and the spatial acoustic transfer characteristics Hro_A are associated with one another to form one data set. Likewise, for the right ear of the person A being measured, the first envelope data AR_bim_max, the second envelope data AR_bim_min, the ear canal transfer characteristics ECTFR_A, the spatial acoustic transfer characteristics Hrs_A, and the spatial acoustic transfer characteristics Hlo_A are associated with one another to form one data set. Likewise, for the left ear of the person B being measured, the first envelope data BL_bim_max, the second envelope data BL_bim_min, the ear canal transfer characteristics ECTFL_B, the spatial acoustic transfer characteristics Hls_B, and the spatial acoustic transfer characteristics Hro_B are associated with one another to form one data set. Likewise, for the right ear of the person B being measured, the first envelope data BR_bim_max, the second envelope data BR_bim_min, the ear canal transfer characteristics ECTFL_B, the spatial acoustic transfer characteristics Hrs_B, and the spatial acoustic transfer characteristics Hlo_B are associated with one another to form one data set.

Note that a pair of the spatial acoustic transfer characteristics 1 and 2 is the first preset data. Specifically, the spatial acoustic transfer characteristics 1 and the spatial acoustic transfer characteristics 2 that form one data set is the first preset data. The first envelope data, the second envelope data, and the ear canal transfer characteristics that form one data set is the second preset data. One data set includes the first preset data and the second preset data. Then the data storage unit 303 stores the first preset data regarding the spatial acoustic transfer characteristics and the second preset data regarding the ear canal transfer characteristics associated for each of the left and right ears of a person being measured. The data storage unit 303 stores first and second preset data of a plurality of data sets.

The clustering unit 315 clusters the second preset data based on the first and second envelope data. In this example, the clustering unit 315 divides the second preset data into a plurality of clusters (groups) using a pair of the first and second envelope data. The clustering unit 315 is able to cluster the second preset data in accordance with the distance between feature quantity vectors by using the first and second envelope data collected as one feature quantity vector. Alternatively, the clustering unit 315 may separately cluster the first envelope data and the second envelope data, the results of clustering the first envelope and the results of clustering the second envelope may be combined with each other, and then they may be divided. The clustering may either be non-hierarchical clustering or hierarchical clustering.

For example, the clustering unit 315 classifies the second preset data into k parts by a k-means method in which data is classified into k preset clusters. One cluster includes second preset data of a plurality of sets. One cluster includes second preset data acquired by second pre-measurement on a plurality of persons being measured. Second preset data regarding a plurality of ears belong to one cluster. One cluster includes a plurality of data sets shown in FIG. 9. Note that the clustering method is not limited to the k-means method.

The representative feature quantity calculation unit 316 calculates representative feature quantities for each cluster. The representative feature quantity calculation unit 316 calculates representative feature quantities based on the first and second envelope data included in one cluster. The representative feature quantities are feature quantity vectors that represent the features of the ear canal transfer characteristics of the ears of the persons being measured who belong to the cluster.

FIG. 10 is a table for describing the data structure of each cluster. FIG. 10 is a table showing data of k (k is an integer of 2 or more) clusters. A first representative feature quantity and a second representative feature quantity are associated for each of the clusters. Further, ID of person being measured who belongs to each cluster, and left/right of ear of this person are stored. As shown in FIG. 10, the data storage unit 303 stores data regarding the clusters. The data format shown in FIG. 10 is merely an example, and a data format where objects of the respective parameters are stored in association by tags or the like may be used instead of the table format.

The first cluster (cluster 1) includes second parameter data of the left ear and the right ear of a person A being measured, the left ear of a person B being measured and the like. Further, the second cluster (cluster 2) includes second preset data of the left ear of a person C being measured, the left ear of the person D being measured and the like. The k-th cluster (cluster k) includes second preset data of the left ear and the right ear of a person Z being measured. One cluster includes a plurality of persons being measured.

The first cluster includes a first representative feature quantity 1_bim_max and a second representative feature quantity 1_bim_min. Likewise, the second cluster includes a first representative feature quantity 2_bim_max and a second representative feature quantity 2_bim_min. The k-th cluster includes a first representative feature quantity k_bim_max and a second representative feature quantity k_bim_min.

The first representative feature quantity is data that corresponds to the first envelope data obtained from the local maximum values and the second representative feature quantity is data that corresponds to the second envelope data obtained from the local minimum values. The first representative feature quantity 1_bim_max is data obtained from a plurality of pieces of first envelope data that belong to the cluster 1. The second representative feature quantity 1_bim_min is data obtained from a plurality of pieces of second envelope data that belong to the cluster 1. For the second to k-th clusters as well, the first representative feature quantity is obtained from the first envelope data that belongs to each cluster. Likewise, for the second to k-th clusters as well, the second representative feature quantity is obtained from the second envelope data that belongs to each cluster.

For example, an average value of one or more pieces of first envelope data that belong to each cluster may be used as the first representative feature quantity. Likewise, an average value of one or more pieces of second envelope data that belong to each cluster may be used as the second representative feature quantity. An average value of amplitude values is obtained for each frequency and this average value is used as the representative value. A set of representative values in all the bands is used as the first and second representative feature quantities. As a matter of course, a median value of the first and second envelope data may be used as the representative value, not the average value of the first and second envelope data. The first representative feature quantity and the first envelope data are in vector form with the same number of dimensions. The second representative feature quantity and the second envelope data are in vector form with the same number of dimensions. The data storage unit 303 stores the first representative feature quantity and the second representative feature quantity.

As described above, the first envelope data and the second envelope data can be clustered separately from each other. FIGS. 11 and 12 are tables each showing data of clusters when the first envelope data and the second envelope data are clustered separately from each other. FIG. 11 is a table showing data obtained by clustering the first envelope data. FIG. 12 is a table showing data obtained by clustering the second envelope data.

The first representative feature quantity is obtained for the clusters when the first envelope data is clustered and the second representative feature quantity is obtained for the clusters when the second envelope data is clustered. The comparison unit 302 compares a user feature quantity which is based on the first envelope data with the first representative feature quantity. The comparison unit 302 compares a user feature quantity which is based on the second envelope data with the second representative feature quantity. Then the comparison unit 302 determines a similar cluster based on two comparison results.

When the first envelope data and the second envelope data are clustered separately from each other, the number of divided clusters in the first envelope data may be different from that in the second envelope data. In this case, the number of divided clusters k is expressed by all the combinations of the number of divided clusters of the first envelope data and the number of divided clusters of the second envelope data. For example, in FIG. 11, the first envelope data is divided into q (q is an integer of 2 or more) clusters, and in FIG. 12, the second envelope data is divided into r (r is an integer of 2 or more) clusters. In this case, the number of divided clusters k can be expressed by k=q*r. Further, the first and second envelop data may be divided into two or more bands and two or more pieces of first envelope data and two or more pieces of second envelope data may be combined.

As described above, by separately clustering the first envelope data and the second envelope data, a plurality of clusters may be generated. When the number of clusters divided in the first envelope data is two and the number of clusters divided in the second envelope data is three, a combination of six clusters (1,1), (1,2), (1,3), (2,1), (2,2), and (2,3) can be obtained. In this case, it is possible that the number of pieces of data that belong to a cluster may become 0. When there is a certain correlation between the first envelope data and the second envelope data, the number of persons who belong to two clusters may become 0.

When, for example, the cluster (2,3) is a similar cluster, the number of persons being measured who belong to the cluster 2 of the first envelope data and to the cluster 3 of the second envelope data may become zero. In this case, the extraction unit 304 is able to extract a similar data set from a neighboring cluster. A cluster having a representative feature quantity whose distance from the second representative feature quantity of the cluster 3 of the second envelope data is the shortest among representative feature quantities of the clusters 1 and 2 of the second envelope data is called a neighboring cluster. It is assumed, for example, that the neighboring cluster of the cluster 3 of the second envelope data is cluster 2. In this case, a similar data set is extracted from the cluster (2,2), which is the neighboring cluster.

While data is clustered by mixing L-ch (left ear) data and R-ch (right ear) data in FIGS. 10, 11, and 12, the L-ch data and the R-ch data may be clustered separately from each other. When the L-ch data and the R-ch data are clustered separately from each other, the first representative feature quantity and the second representative feature quantity are set for the L-ch cluster. Likewise, the first representative feature quantity and the second representative feature quantity are set for the R-ch cluster.

Next, processing for determining a filter based on user data will be described. The receiving unit 301 receives user data transmitted from the out-of-head localization device 100. In this example, the user data are user feature quantities including the first envelope data user-bim_max and the second envelope data user-bim_min.

The comparison unit 302 compares the user feature quantities with the representative feature quantities. The comparison unit 302 calculates a similarity score for each cluster by comparing the user feature quantities with the representative feature quantities of each cluster. The cluster with the highest similarity score is a similar cluster. The comparison unit 302 performs matching for all the clusters.

The comparison unit 302 further compares the user feature quantities with the second preset data included in the similar cluster. That is, the comparison unit 302 calculates the similarity score for each data set by comparing the user feature quantities with the first and second envelope data of each data set. A data set with the highest similarity is a similar data set.

In the following description, one example of processing in the comparison unit 302 will be described. As described above, the user feature quantities include the first envelope data user-bim_max and the second envelope data user-bim_min. Further, each cluster includes the first representative feature quantity (e.g., 1_bim_max) that corresponds to the first envelope data and the second representative feature quantity (e.g., 1_bim_min) that corresponds to the second envelope data.

The comparison unit 302 calculates a correlation coefficient r_max between the first envelope data user-bim_max and the first representative feature quantity (e.g., 1_bim_max). The comparison unit 302 calculates a Euclidean distance q_max between the first envelope data user-bim_max and the first representative feature quantity (e.g., 1_bim_max). The comparison unit 302 calculates a correlation coefficient r_min between the second envelope data user-bim_min and the second representative feature quantity (e.g., 1_bim_min). The comparison unit 302 calculates a Euclidean distance q_min between the second envelope data user-bim_min and the second representative feature quantity (e.g., 1_bim_min).

The comparison unit 302 calculates a similarity score based on the correlation coefficient r_max, the Euclidean distance q_max, the correlation coefficient r_min, and the Euclidean distance q_min. The smaller the value of the Euclidean distance q becomes, the shorter the distance becomes, indicating that they have more similar characteristics. The correlation coefficient r has a value between −1 and +1, and as this value becomes closer to +1, it means that they have more similar characteristics. Therefore, as the value of (1−r) becomes smaller, it means that their characteristics are more similar with each other.

The comparison unit 302 calculates a similarity score by calculating a weighted sum of four values (1−r_max), q_max, q_min, and (1−r_min). The weight used for the calculation of the weighted sum can be set as appropriate. The comparison unit 302 calculates a similarity score for each cluster. The comparison unit 302 sets the cluster with the highest similarity score as a similar cluster. In this manner, the similar cluster that is most similar to the user feature quantities (user data) is selected. Note that the comparison unit 302 may calculate a similarity score using only one of the distance between vectors and the correlation coefficient. Note that the similarity score may be calculated using cosine similarity (cosine distance), Mahalanobis' distance, Pearson correlation coefficient or the like instead of using the magnitudes of the correlation value and the distance vector (Euclidean distance). Further, the comparison unit 302 may determine two or more similar clusters.

Then the comparison unit 302 compares the user feature quantities with each data set of the second preset data that belongs to the similar cluster. Assume, for example, that the similar cluster is the first cluster (cluster 1) in the table shown in FIG. 10. In this case, the similar cluster includes a data set of the left ear of the person A being measured, a data set of the right ear of the person A being measured, a data set of the left ear of the person B being measured and the like. The comparison unit 302 performs matching for all the data sets included in the similar cluster.

As shown in FIG. 9, each data set includes first envelope data (e.g., AL_bim_max) and second envelope data (e.g., AL_bim_min). The first envelope data (e.g., AL_bim_max) and the second envelope data (e.g., AL_bim_min) are feature quantities of the data set. The comparison unit 302 compares the first envelope data user-bim_max included in the user feature quantities with the first envelope data (e.g., AL_bim_max) of the second preset data. The correlation coefficient and the Euclidean distance are thus obtained. Likewise, the comparison unit 302 compares the second envelope data user-bim_min included in the user feature quantities with the second envelope data (e.g., AL_bim_min) of the second preset data. The correlation coefficient and the Euclidean distance are thus obtained.

The comparison between the user feature quantities and the feature quantities of a data set is similar to the comparison between the user feature quantities and the representative feature quantities of a cluster. Therefore, in the comparison between the user feature quantities and the feature quantities of the data set as well, the correlation coefficient r_max, the Euclidean distance q_max, the correlation coefficient r_min, and the Euclidean distance q_min are obtained. The comparison unit 302 calculates the similarity score by calculating a weighted sum of four values of (1−r max), q_max, q_min, (1−r_min). The similarity score is calculated for each data set. The comparison unit 302 sets the data set with the highest similarity score as a similar data set. In this manner, the similar data set that is most similar to the user feature quantities (user data) is selected. The weight used in the comparison in the cluster and that used in the comparison in the data set may be appropriately changed. Alternatively, an index (cosine distance and the like) used in the comparison in the cluster and that used in the comparison in the data set may be different from each other.

The extraction unit 304 extracts the first preset data that corresponds to the similar data set. That is, the extraction unit 304 reads out the spatial acoustic transfer characteristics 1 (e.g., Hls_A) and the spatial acoustic transfer characteristics 2 (e.g., Hro_A) included in the similar data set from the data storage unit 303.

The determination unit 305 determines the spatial acoustic filter based on the extracted first preset data. Note that the determination unit 305 may determine the spatial acoustic filter by correcting the spatial acoustic transfer characteristics 1 and the spatial acoustic transfer characteristics 2. Alternatively, the determination unit 305 may directly use the spatial acoustic transfer characteristics 1 and the spatial acoustic transfer characteristics 2 for the spatial acoustic filter. The transmitting unit 306 transmits the spatial acoustic filter to the out-of-head localization device 100.

The receiving unit 132 of the out-of-head localization device 100 shown in FIG. 4 receives the spatial acoustic filter. The spatial acoustic filter received by the receiving unit 132 is stored in the filter storage unit 122. The above processing is performed for each of the left and right ear canal transfer characteristics. In this manner, four spatial acoustic filters in accordance with the spatial acoustic transfer characteristics Hls, Hlo, Hro, and Hrs are set.

For example, the server device 300 performs the above processing on the measurement data ECTFL of the left ear, whereby spatial acoustic filters in accordance with the spatial acoustic transfer characteristics Hls and Hro are generated. The server device 300 performs the above processing on the measurement data ECTFR of the right ear, whereby spatial acoustic filters in accordance with the spatial acoustic transfer characteristics Hlo and Hrs are generated.

In the comparison unit 302, it is possible that the right ear of the person being measured may match the left ear of the user. That is, the shape of the left ear of the user may be similar to the shape of the right ear of the person being measured. In this case, the filter of the spatial acoustic transfer characteristics Hls of the user is determined based on the spatial acoustic transfer characteristics 1 (e.g., Hrs_A) and the filter of the spatial acoustic transfer characteristics Hro of the user is determined based on the spatial acoustic transfer characteristics 2 (e.g., Hlo_A). Likewise, the left ear of the person being measured may match the right ear of the user.

In this embodiment, envelope data in accordance with local maximum values and local maximum values are feature quantities. The server device 300 performs matching based on the feature quantities. Since the comparison unit 302 compares the envelope data pieces indicating the outline of the frequency-amplitude characteristics, feature quantities indicating user's individual characteristics are likely to appear. It is therefore possible to perform out-of-head localization processing by appropriately using the spatial acoustic filter suitable for the user.

Further, representative feature quantities are obtained for each cluster. The comparison unit 302 determines a similar cluster by comparing the user feature quantities with the representative feature quantities. In this manner, there is no need to calculate similarity scores for all the data sets obtained in the pre-measurement. The data set whose similarity score is calculated can be selected. Therefore, when the data sets of a large number of persons being measured are stored in a database, it becomes possible to shorten the processing time.

Figure 13:
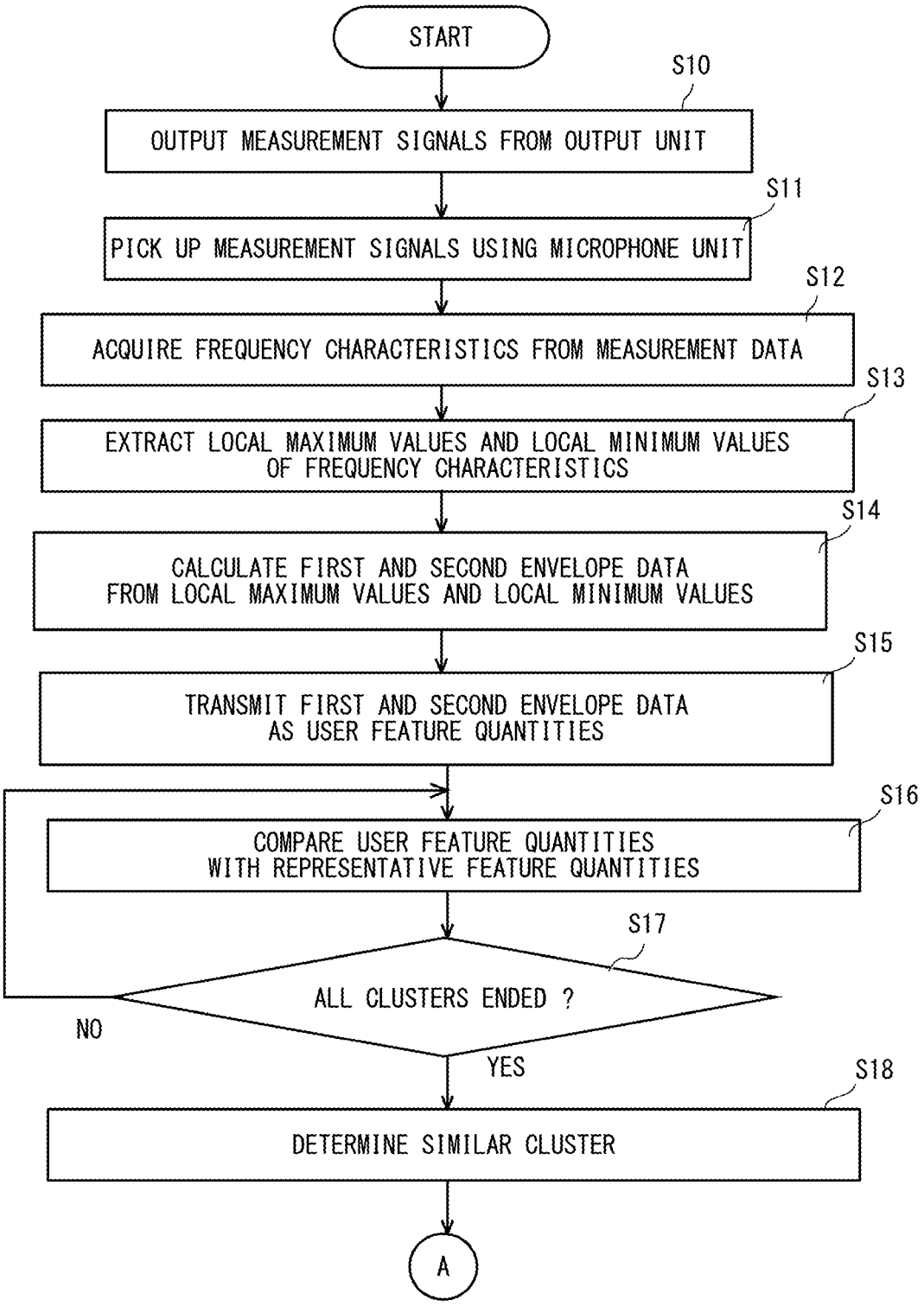
FIG. 13 is a flowchart showing an out-of-head localization filter determination method.
Figure 14:
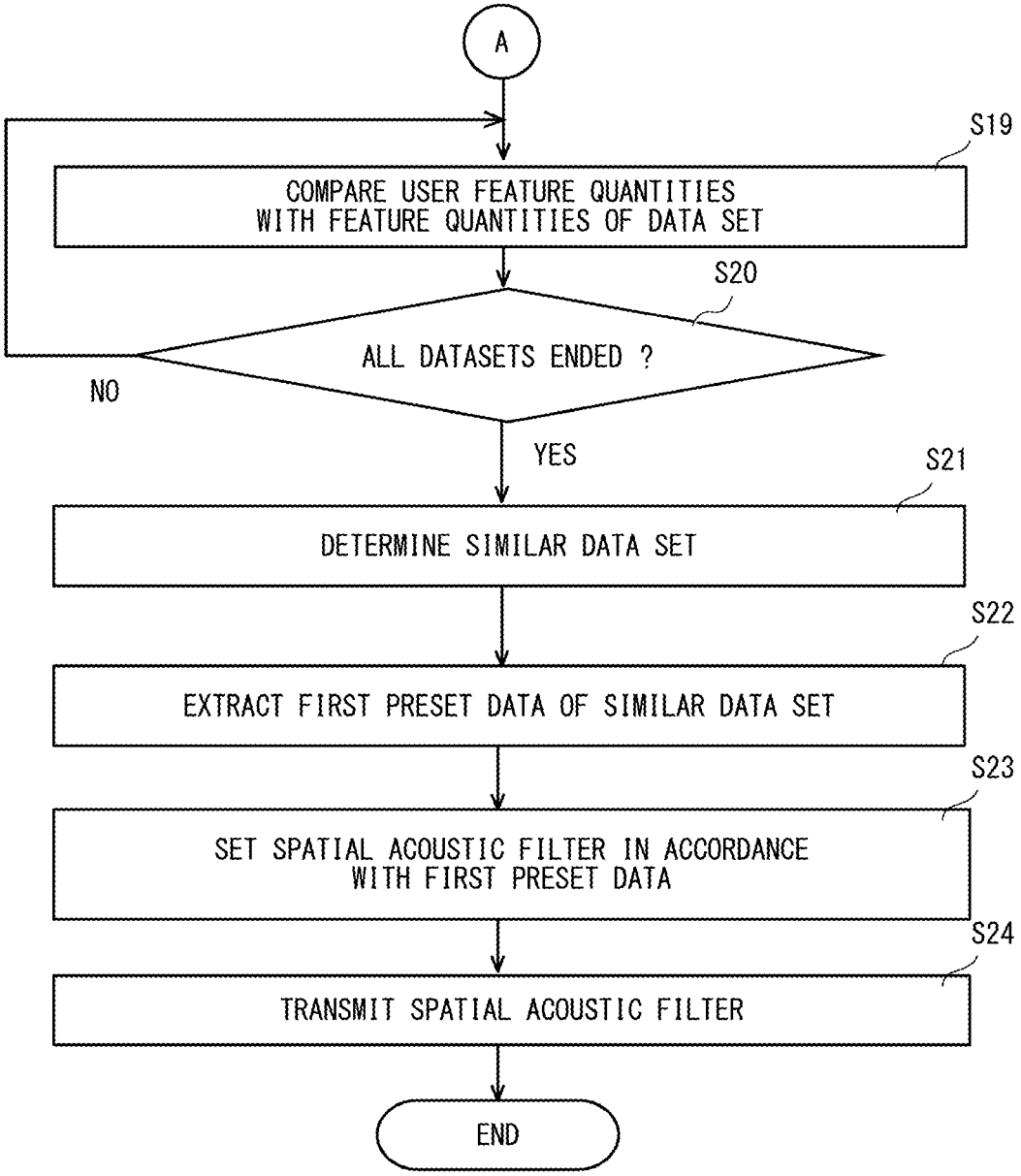
FIG. 14 is a flowchart showing the out-of-head localization filter determination method.

With reference to FIGS. 13 and 14, one example of the out-of-head localization filter determination method according to this embodiment will be described. FIGS. 13 and 14 are flowcharts showing a determination method for determining the spatial acoustic filter.

First, as shown in FIG. 4, the impulse response measurement unit 111 outputs measurement signals from the output unit of the headphones 43 (S10). The impulse response measurement unit 111 picks up the measurement signals using the microphone unit 2 (S11). The impulse response measurement unit 111 acquires the measurement data ECTFL and ECTFR regarding the ear canal transfer characteristics of the user U. The impulse response measurement unit 111 may perform synchronous addition processing.

Next, the frequency characteristics acquisition unit 112 acquires the frequency characteristics from the measurement data ECTFL and ECTFR (S12). The frequency characteristics acquisition unit 112 performs Fourier transform on the measurement data ECTFL and ECTFR in the time domain, whereby frequency-amplitude characteristics and frequency-phase characteristics are obtained. The frequency characteristics acquisition unit 112 may smooth the frequency-amplitude characteristics. Further, the inverse filter calculation unit 121 may calculate the inverse filters Linv and Rinv based on the frequency characteristics.

The extreme value extraction unit 113 extracts local maximum values and local minimum values of the smoothed frequency-amplitude characteristics (S13). The envelope calculation unit calculates the first and second envelope data from the local maximum values and the local minimum values (S 14). That is, the envelope calculation unit 114 calculates the first envelope data user-bim_max based on a plurality of local maximum values. The envelope calculation unit 114 calculates the second envelope data user-bim_min based on a plurality of local minimum values. For example, the envelope calculation unit 114 calculates the first envelope data user-bim_max by interpolating the local maximum values. The envelope calculation unit 114 calculates the second envelope data user-bim_min by interpolating the local minimum values.

The transmitting unit 131 transmits, as the user feature quantities, the first and second envelope data to the server device 300 (S15). Specifically, a set of amplitude values of the first envelope data user-bim_max and the second envelope data user-bim_min is transmitted as user feature quantities.

While the transmitting unit 131 transmits, as the user feature quantities, the first and second envelope data to the server device 300 in this example, the transmitting unit 131 may transmit the measurement signals (measurement data ECTFL and ECTFR) themselves to the server device 300. In this case, the processing in S12-S14 is executed in the server device 300. Specifically, the server device 300 or the measurement device 200 is able to perform processing in S12-S14 in accordance with the data that the transmitting unit 131 transmits to the server device 300.

The comparison unit 302 compares the user feature quantities with the representative feature quantities (S16). The comparison unit 302 compares the first envelope data user-bim_max with the first representative feature quantity (e.g., 1-bim_max) of the cluster. Further, the comparison unit 302 compares the second envelope data user-bim_min with the second representative feature quantity (e.g., 1-bim_min) of the cluster. The similarity score for one cluster is thus obtained.

The comparison unit 302 determines whether or not all the clusters have been ended (S17). When any one of the clusters has not been ended (NO in S17), the process returns to Step S16, where the comparison unit 302 compares the user feature quantities with the representative feature quantities of the next cluster. When all the clusters have been ended (YES in S17), the comparison unit 302 determines the similar cluster (S18). That is, the cluster with the highest similarity score is determined to be a similar cluster.

Next, the user feature quantities are compared with the feature quantities of the data set included in the similar cluster (S19). Specifically, the comparison unit 302 compares the first envelope data user-bim_max with the first envelope data (e.g., AL-bim_max) of the cluster. Further, the comparison unit 302 compares the second envelope data user-bim_min with the second envelope data (e.g., AL-user-bim_min) of the cluster. The similarity score for one data set is thus obtained.

The comparison unit 302 determines whether or not all the data sets that belong to a cluster have been ended (S20). When any one of the data sets has not been ended (NO in S20), the process returns to Step S19, where the comparison unit 302 compares the user feature quantities with the representative feature quantities of the next data set. When all the data sets have been ended (YES in S20), the comparison unit 302 determines the similar data set (S21). That is, the data set with the highest similarity score is determined to be a similar data set.

The extraction unit 304 extracts the first preset data of the similar data set (S22). Specifically, the extraction unit 304 extracts one first preset data from among a plurality of pieces of first preset data included in the similar cluster. The determination unit 305 determines the spatial acoustic filter in accordance with the extracted first preset data (S23). Then the transmitting unit 306 transmits the spatial acoustic filter to the out-of-head localization device 100 (S24).

In this manner, the spatial acoustic filter can be appropriately determined. While the server device 300 determines the spatial acoustic filter in the above description, a part of the processing for determining the spatial acoustic filter may be executed in the out-of-head localization device 100. For example, the transmitting unit 306 may transmit the first preset data to the out-of-head localization device 100, correct the first preset data in the out-of-head localization device 100, and determine the spatial acoustic filter.

The clustering unit 315 may perform clustering in a divided manner for each band. When, for example, data is divided into two bands, that is, a high band and a low band, the data is clustered in each of the high band and the low band. Each of the similar cluster in the high band and the similar cluster in the low band may be obtained. In this case, the similar data set in the high band and that in the low band are different from each other. Therefore, the spatial acoustic filter may be generated by synthesizing the first preset data in the high band (spatial acoustic transfer characteristics) and the first preset data in the low band (spatial acoustic transfer characteristics). Alternatively, the correlation coefficient and the Euclidean distance in the high band and those in the low band may be obtained. Then the similar cluster may be obtained by calculating a weighted sum of the correlation coefficient and the Euclidean distance in the high band and the correlation coefficient and the Euclidean distance in the low band.

While the extreme value extraction unit extracts the local maximum values and the local minimum values of the smoothed frequency characteristics in the aforementioned processing, smoothed parameters may be adjusted for each band.

In the processing of extracting the extreme values, a threshold may be set for amplitude values of the frequency-amplitude characteristics of the local maximum values and the local minimum values. Then when amplitude values exceed the threshold, the values of the extreme values may be rounded to a threshold. In this manner, it is possible to prevent clustering from being biased due to steep local maximum values or local minimum values.

Further, the similarity score may be obtained for all the data sets without performing clustering. The frequency characteristics acquisition unit 312, the extreme value extraction unit 313, the envelope calculation unit 314, the clustering unit 315, the representative feature quantity calculation unit 316 are unnecessary. Further, Steps S16-S18 in FIG. 13 may not be always performed.

Note that the spatial acoustic filter may be determined by correcting matched spatial acoustic transfer characteristics in the comparison unit 302. For example, the spatial acoustic filter may be generated by mixing the matched spatial acoustic transfer characteristics with representative characteristics with no difference in characteristics between the left and right ears. Specifically, the matched spatial acoustic transfer characteristics may be directly used in a band equal to or higher than a desired frequency and the representative characteristics may be used in a band lower than the desired frequency.

Note that at least a part of the processing of the out-of-head localization device 100 may be performed in the server device 300. For example, the processing of the frequency characteristics acquisition unit 112, the extreme value extraction unit 113, and the envelope calculation unit 114 may be performed in the server device 300. A part of the processing of the server device 300 may be performed in the out-of-head localization device 100. Alternatively, a device that is physically different from the out-of-head localization device 100, the measurement processor 201, and the server device 300 may perform a part of the above processing.

Modified Example 1

In Modified Example 1, processing of determining a similar data set from among similar clusters is different from the one described above. In Modified example 1, the comparison unit 302 determines the similar data set based on a correlation of the frequency characteristics of the ear canal transfer characteristics, not based on the feature quantities (envelope data). For example, the comparison unit 302 is able to obtain the correlation of frequency characteristics of the ear canal transfer characteristics in a desired band and determine a data set with the highest correlation to be a similar data set.

A part or the whole of the above-described processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as flexible disks, magnetic tapes, hard disk drives, etc.), optical magnetic storage media (e.g. magneto-optical disks), CD-ROM (Read Only Memory), CD-R, CD-R/W, and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

Although embodiments of the invention made by the present invention are described in the foregoing, the present invention is not restricted to the above-described embodiments, and various changes and modifications may be made without departing from the scope of the invention.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

A (The) program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

The above embodiment and its modified example can be combined as desirable by one of ordinary skill in the art.

What is claimed is:

1. An out-of-head localization filter determination system comprising:

an output unit configured to be worn on a user and output sounds to an ear of the user;

a microphone unit configured to be worn on the ear of the user and pick up the sounds output from the output unit;

a measurement unit configured to output a measurement signal to the output unit and measure a sound pickup signal output from the microphone unit;

a data storage unit configured to store first preset data related to spatial acoustic transfer characteristics from a sound source to an ear of a person being measured and second preset data related to ear canal transfer characteristics of the ear of the person being measured in association with each other, and store a plurality of first and second preset data acquired for a plurality of persons being measured;

a frequency characteristics acquisition unit configured to convert the sound pickup signal into a frequency domain and acquire frequency characteristics;

an extreme value extraction unit configured to extract a local maximum value and a local minimum value of the frequency characteristics;

an envelope calculation unit configured to calculate first envelope data which is based on the local maximum value and second envelope data which is based on the local minimum value by interpolating each of the local maximum value and the local minimum value;

a comparison unit configured to compare a user feature quantity which is based on the first and second envelope data with each of a plurality of feature quantities which are based on the plurality of pieces of second preset data;

an extraction unit configured to extract the first preset data based on the comparison result in the comparison unit; and a determination unit configured to determine a filter in accordance with the first preset data that has been extracted.

2. The out-of-head localization filter determination system according to claim 1, wherein the data storage unit stores a plurality of data sets, one data set being formed of the first preset data and the second preset data, the plurality of pieces of second preset data are classified into a plurality of clusters, the comparison unit determines a similar cluster from the plurality of clusters by comparing a representative feature quantity for each of the clusters with the user feature quantity, and the comparison unit determines a similar data set from the similar cluster by comparing a feature quantity of the second preset data that belongs to the similar cluster with the user feature quantity, and the determination unit extracts first preset data that corresponds to the similar data set and determines a filter in accordance with the extracted first preset data.

3. The out-of-head localization filter determination system according to claim 2, wherein the second preset data is separately clustered by the first envelope data and the second envelope data, whereby the plurality of pieces of second preset data are classified into a plurality of clusters, a first representative feature quantity is associated with a cluster divided by the first envelope data, a second representative feature quantity is associated with a cluster divided by the second envelope data, and the comparison unit compares a user feature quantity which is based on the first envelope data with the first representative feature quantity and compares a user feature quantity which is based on the second envelope data with the second representative feature quantity.

4. The out-of-head localization filter determination system according to claim 2, wherein the second preset data is divided into a plurality of bands, and the second preset data is clustered for each of the bands.

5. An out-of-head localization filter determination method in a system comprising:

an output unit configured to be worn on a user and output sounds to an ear of the user;

a microphone unit configured to be worn on the ear of the user and pick up the sounds output from the output unit;

a data storage unit configured to store first preset data related to spatial acoustic transfer characteristics from a sound source to an ear of a person being measured and second preset data related to ear canal transfer characteristics of the ear of the person being measured in association with each other, the data storage unit storing a plurality of pieces of first and second preset data acquired for a plurality of persons being measured, the method comprising:

an output step for outputting a measurement signal to each output unit worn on the user;

a signal acquisition step for acquiring a pickup signal when the measurement signal output from the output unit toward the user's ear is picked up by a microphone unit worn on the ear of the user;

a frequency characteristics acquisition step for converting the sound pickup signal into a frequency domain and acquiring frequency characteristics;

an extreme value extraction step for extracting a local maximum value and a local minimum value of the frequency characteristics;

a calculation step for calculating first envelope data which is based on the local maximum value and second envelope data which is based on the local minimum value by interpolating each of the local maximum value and the local minimum value;

a comparing step for comparing a user feature quantity which is based on the first and second envelope data with each of a plurality of feature quantities which are based on a plurality of pieces of second preset data;

an extraction step for extracting the first preset data based on a comparison result in the comparing step; and a determination step for determining a filter in accordance with the extracted first preset data.

6. A non-transitory computer readable medium storing a program for causing a computer to execute an out-of-head localization filter determination method, wherein the computer is able to access a data storage unit configured to store first preset data related to spatial acoustic transfer characteristics from a sound source to an ear of a person being measured and second preset data related to ear canal transfer characteristics of the ear of the person being measured in association with each other, the data storage unit storing a plurality of pieces of first and second preset data acquired for a plurality of persons being measured, and the out-of-head localization filter determination method comprises:

an output step for outputting a measurement signal to each output unit worn on a user;

a signal acquisition step for acquiring a pickup signal when the measurement signal output from the output unit toward the user's ear is picked up by a microphone unit worn on the ear of the user;

a frequency characteristics acquisition step for converting the sound pickup signal into a frequency domain and acquiring frequency characteristics;

an extreme value extraction step for extracting a local maximum value and a local minimum value of the frequency characteristics;

a calculation step for calculating first envelope data which is based on the local maximum value and second envelope data which is based on the local minimum value by interpolating each of the local maximum value and the local minimum value;

a comparing step for comparing a user feature quantity which is based on the first and second envelope data with each of a plurality of feature quantities which are based on a plurality of pieces of second preset data;

an extraction step for extracting the first preset data based on a comparison result in the comparing step; and a determination step for determining a filter in accordance with the extracted first preset data.

* * * * *